US012529305B1

(12) United States Patent
Richards

(10) Patent No.: US 12,529,305 B1
(45) Date of Patent: Jan. 20, 2026

(54) AXIAL SINUSOIDAL PULSER

(71) Applicant: Schlumberger Technology Corporation, Sugar Land, TX (US)

(72) Inventor: Edward Richards, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/883,260

(22) Filed: Sep. 12, 2024

(51) Int. Cl.
*E21B 47/18* (2012.01)

(52) U.S. Cl.
CPC ..... *E21B 47/18* (2013.01)

(58) Field of Classification Search
CPC ..... E21B 47/18; E21B 47/24; F16K 15/021; F16K 27/02
See application file for complete search history.

(56) References Cited

U.S. PATENT DOCUMENTS 7,417,920 B2 * 8/2008 Hahn ..... E21B 47/24 367/83
7,881,155 B2 * 2/2011 Close ..... G01V 11/00 175/48
9,194,211 B2 * 11/2015 Lefebvre ..... F16K 31/084
11,913,327 B2 * 2/2024 Richards ..... E21B 47/24
2004/0069530 A1 * 4/2004 Prain ..... E21B 47/22 175/40
2011/0011594 A1 * 1/2011 Young ..... E21B 47/18 175/48
2015/0260014 A1 * 9/2015 Zimmerman ..... E21B 47/18 166/66.5
2019/0211673 A1 * 7/2019 Gopalan ..... E21B 34/16
2023/0313677 A1 * 10/2023 Twynam ..... E21B 47/18 367/83

OTHER PUBLICATIONS ip.com, Mud valve with flexible structure and particularly LCM Tolerant (Year: 2018).*
Keim, Robert, "Understanding Quadrature Phase Shift Keying (QPSK) Modulation", Retreived from the internet at https://www.allaboutcircuits.com/technical-articles/quadrature-phase-shift-keying-qpsk-modulation/, Aug. 17, 2016, 3 Pages.
(Continued)

*Primary Examiner* — Quan Zhen Wang
*Assistant Examiner* — Jerold B Murphy
(74) *Attorney, Agent, or Firm* — Jeffrey D. Frantz

(57) ABSTRACT

A mud pulse telemetry system is disclosed including a drill string positioned within a wellbore, a restriction positioned within the drill string and configured to create a pressure differential between a high pressure region and a low pressure region of the drill string, a piston including a piston opening positioned within a piston chamber and movable along an axis between a first position and a second position, a valve movable to selectively open the piston opening, and a pulser coupled to the piston and positioned for movement within the drill string along the axis. The pulser includes a pulser body having at least a portion thereof with a non-linear profile and a conduit extending through the pulser body and facilitating fluid communication between the drill string and the piston chamber. Movement of the pulser body generates a pressure wave through mud within the drill string.

19 Claims, 16 Drawing Sheets

(56) References Cited

OTHER PUBLICATIONS

Mwachaka, S. M. et al., "A Review of Mud Pulse Telemetry Signal Impairments Modeling and Suppression Methods", In Journal of Petroleum Exploration and Production Technology, vol. 9, Jun. 2018, pp. 779-792.
"Hydraulic Percussion Hammer Drive Mechanisms", Hartrusion—Engineering Website Blog, retrieved from https://hartrusion.com/en/hydrdthhammer/drivemechanisms/, Retrieved on Nov. 21, 2024, 11 Pages.

* cited by examiner

AXIAL SINUSOIDAL PULSER

TECHNICAL FIELD

The present disclosure relates to down-hole drilling systems, and more particularly to a mud pulse telemetry system.

BACKGROUND

When conducting drilling operations (e.g., to tap subsurface hydrocarbon deposits), mud pulse telemetry systems enable an operator at the surface to monitor downhole conditions. For example, a mud pulse telemetry system may enable the operator to monitor real-time data by transmitting a modulated pressure wave uphole via mud within the drill string while drilling operations are performed. The pressure wave can be encoded with information regarding temperature, pressure, or other downhole conditions that inform operational decisions at the surface. The communication provided by mud pulse telemetry systems enables safer, more complex, and more efficient drilling operations.

SUMMARY

In one independent aspect, a mud pulse telemetry system includes a drill string configured to be positioned in a wellbore; a restriction positioned within the drill string and configured to create a pressure differential between a high pressure region of the drill string on a first side of the restriction and a low pressure region of the drill string on a second side of the restriction; a piston including a piston opening, the piston positioned in a piston chamber and movable along an axis between a first position and a second position; a valve movable to selectively open the piston opening; and a pulser coupled to the piston opening and positioned for movement within the drill string along the axis. The pulser includes a pulser body at least partially disposed within the restriction and a conduit extending through the pulser body, the conduit facilitating fluid communication between the drill string and the piston chamber. The pulser body includes an outer surface, at least a portion of the outer surface having a non-linear profile, and movement of the pulser body generates a pressure wave through mud within the drill string.

In some aspects, the outer surface of the pulser body is spaced apart from an inner edge of the restriction by a gap, a width of the gap changing as the pulser body moves past the restriction.

In some aspects, the restriction is a knife edge restriction with an annular edge, and the gap is an annular gap.

In some aspects, the restriction generates a pressure differential across the gap.

In some aspects, the pressure differential varies based on the pulser body's position with respect to the restriction.

In some aspects, the piston causes the pulser to move uphole when mud flows into the piston chamber via the conduit and the valve is in a closed position.

In some aspects, the piston causes the pulser to move downhole when the valve moves to an open position and mud exits the piston chamber via the piston opening.

In some aspects, movement of the valve between the closed position and the open position causes the pulser to reciprocate axially within the drill string.

In some aspects, the portion of the outer surface having a non-linear profile is defined by a logarithmic curve.

In some aspects, the mud pulse telemetry system also includes a first dwell region connected to a first end of the pulser body and a second dwell region connected to a second end of the pulser body. The dwell regions are configured to facilitate idling of the pulser such that a phase of the pressure wave transmitted uphole can be shifted.

In some aspects, the pressure wave is sinusoidal.

In some aspects, actuation of the valve is controllable to alter the movement of the pulser, thereby shifting a phase of the sinusoidal pressure wave.

In some aspects, the mud pulse telemetry system also includes a bearing supporting at least a portion of the pulser for axial motion within the drill string. The valve is self-actuating in that the valve is arranged to engage a portion of the bearing when the pulser reaches an uphole position and the valve is arranged to engage a portion of the piston chamber when the pulser reaches a downhole position. Engagement between the valve and the bearing causes the piston opening to open and engagement between the valve and the piston chamber causes the piston opening to close.

In another independent aspect, a mud pulse telemetry system includes a drill string; a pulser positioned within the drill string; and a piston disposed within the drill string and connected to the pulser, the piston configured to generate axial movement of the pulser within the drill string. Axial movement of the pulser within the drill string generates a sinusoidal pressure wave to the surface via mud within the drill string.

In some aspects, information is encoded in the sinusoidal pressure wave using phase modulation.

In some aspects, a portion of the pulser is defined by a transcendental function.

In some aspects, the pulser is positioned within a restriction of the drill string such that a gap is formed between the restriction and the pulser.

In some aspects, the restriction generates a pressure differential across the gap.

In some aspects, the shape of the portion of the pulser defined by a transcendental function causes the pulser to accelerate or decelerate as the pulser moves axially within the drill string such that the pressure wave generated by the axial movement of the pulser is sinusoidal.

In yet another independent aspect, a mud pulse telemetry system includes a drill string; a pulser supported for axial motion within the drill string between an uphole position and a downhole position; a restriction positioned within the drill string and configured to generate a pressure differential therein between a high pressure region uphole with respect to the restriction and a low pressure region downhole with respect to the restriction; a conduit extending through the pulser, the conduit including a first communication passage facilitating fluid communication between the first piston chamber and the high pressure region and a second communication passage facilitating fluid communication between the second piston chamber and the high pressure region; a first outlet facilitating fluid communication between the first piston chamber and the low pressure region, a first valve configured to selectively open and close the first pipe; and a second outlet facilitating fluid communication between the second piston chamber and the low pressure region, a second valve configured to selectively open and close the second outlet pipe. Cyclical axial motion of the pulser within the drill string generates a sinusoidal pressure wave in an uphole direction.

DETAILED DESCRIPTION

Before any embodiments are explained in detail, it is to be understood that the disclosure is not limited in its application to the details of the configuration and arrangement of components set forth in the following description or illustrated in the accompanying drawings. The disclosure is capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

Figure 1:
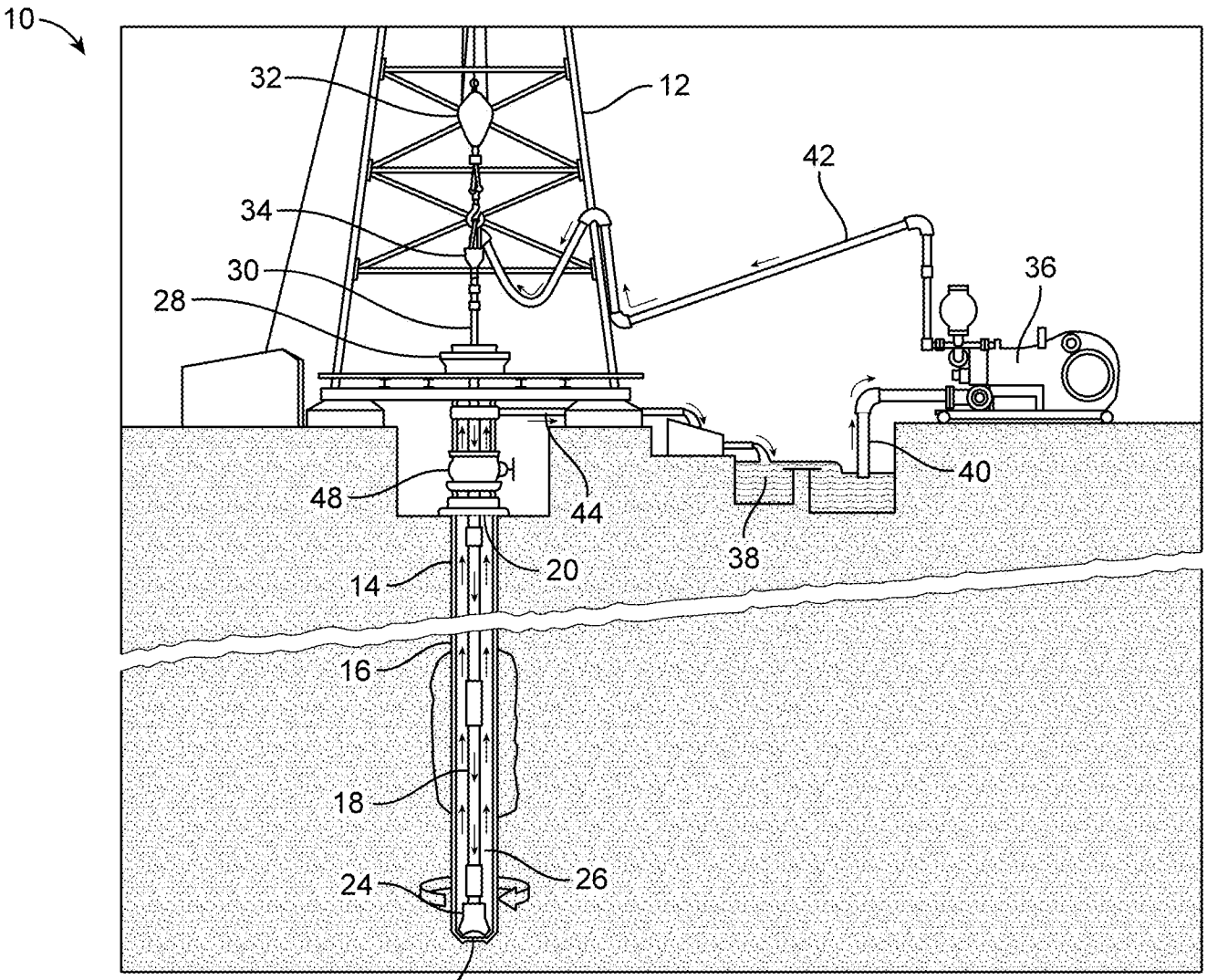
FIG. 1 illustrates a schematic view of a drilling operation.

FIG. 1 illustrates a drilling operation (e.g., for extracting hydrocarbons from subsurface deposits). An oil rig 10 may include a derrick 12 positioned over a wellbore 14. A casing 16 may be positioned within the wellbore 14 and secured in place (e.g., to prevent fluid migration). A drill string 18 may be disposed within the wellbore 14 and extend from a well opening 20 at the surface to a well base 22 at the bottom of the wellbore 14. A drill bit 24 connected to the drill string 18 at the well base 22 may be configured to cut or crush rock such that the drill bit 24 is capable of penetrating subsurface strata. An annular space 26 may be provided between the drill string 18 and the casing 16.

The oil rig 10 may include a rotary table 28 designed to generate torque or rotational motion and a kelly 30 designed to transmit torque or rotational motion from the rotary table 28 to the drill string 18. For example, the kelly 30 may be provided as a section of pipe with a polygonal (e.g., four-sided or six-sided) cross-section, and the rotary table 28 may include a bushing designed to receive the kelly 30 and imparted with a complementary geometry such that rotation of the rotary table 28 causes rotation of the kelly 30 in response. The kelly 30 may be connected to the drill string 18 in any suitable manner.

A hoisting system including a traveling block 32 and a swivel 34 may be supported by the derrick 12 and positioned above the rotary table 28 and/or the kelly 30. The traveling block 32 may facilitate raising and lowering the drill string 18 and associated equipment or parts into and out of the wellbore 14. The swivel 34 may be attached to the traveling block 32 and positioned atop the drill string 18. The swivel 34 may be configured to support rotation of the drill string 18 and the drill bit 24 while maintaining a sealed, pressure-tight fluid system via which drilling fluid (e.g., mud) may enter the wellbore 14.

For example, a mud pump 36 at the surface may drive mud from a reservoir 38 into the wellbore 14. The mud pump 36 may draw mud from the reservoir 38 via an intake pipe 40 and drive the mud to the swivel 34 via a mud hose 42. The mud hose 42 may be connected to the drill string 18 via the swivel 34 and/or the kelly 30 such that the mud hose 42 is in fluid communication with the drill string 18. The mud may flow downhole via the drill string 18 to the drill bit 24 where it may serve a variety of purposes including lubricating and cooling the drill bit 24, maintaining hydrostatic pressure within the wellbore 14, and transporting rock cuttings from the well base 22 to the surface. The mud may be ejected from the drill string 18 through the drill bit 24 at the well base 22 and may return to the surface via the annular space 26 between the drill string 18 and the casing 16.

A mud return 44 may transport the returning mud back to the reservoir 38 such that the mud can be reused. In some cases, a vibrating screen or shaker may be positioned between the mud return 44 and the reservoir 38. The mud may pass through the shaker and the shaker may be configured to clean the mud, for example, by removing bits of rock and other cuttings that traveled with the mud from the well base 22 before the mud is returned to the reservoir 38. A blowout preventer 48 positioned atop the wellbore 14 may be installed as a safety feature and configured to prevent ruptures or explosions that can occur during drilling operations (e.g., when downhole pressures exceed the pressure exerted by the column of mud within the wellbore 14).

A mud pulse telemetry system may be provided within the wellbore 14 to transmit information from the drill string 18 and/or the drill bit 24 to control equipment (not shown) at the surface. The mud pulse telemetry system may be positioned proximate to the well base 22 and configured to generate pressure waves that travel uphole to the surface. The pressure waves may travel uphole, using the mud within the drill string 18 as a medium. Thus, the changes in pressure may be detected by pressure sensors (not shown) positioned at or above the surface (e.g., mounted within the mud hose 42). The data collected by the pressure sensors can be decoded into data that can then be interpreted by operators. The pressure waves may be encoded such that the decoded data provides information regarding temperature, pressure, vibration, rotation of the drill string, and/or other downhole conditions. In this way, the mud pulse telemetry system may aid operators in steering the drill string 18, monitoring the conditions of the drill bit 24, reduce the risk of accident, and improve the efficiency and safety of drilling operations.

Mud pulse telemetry systems include a pulser to generate pressure waves to the surface. An axial pulser may create pressure waves via movement along an axis (e.g., the axis of the drill string 18), while a radial pulser may create pressure waves by rotating a stator and a rotor with unevenly spaced openings or slots to modulate the flow of mud therethrough.

Figure 2:
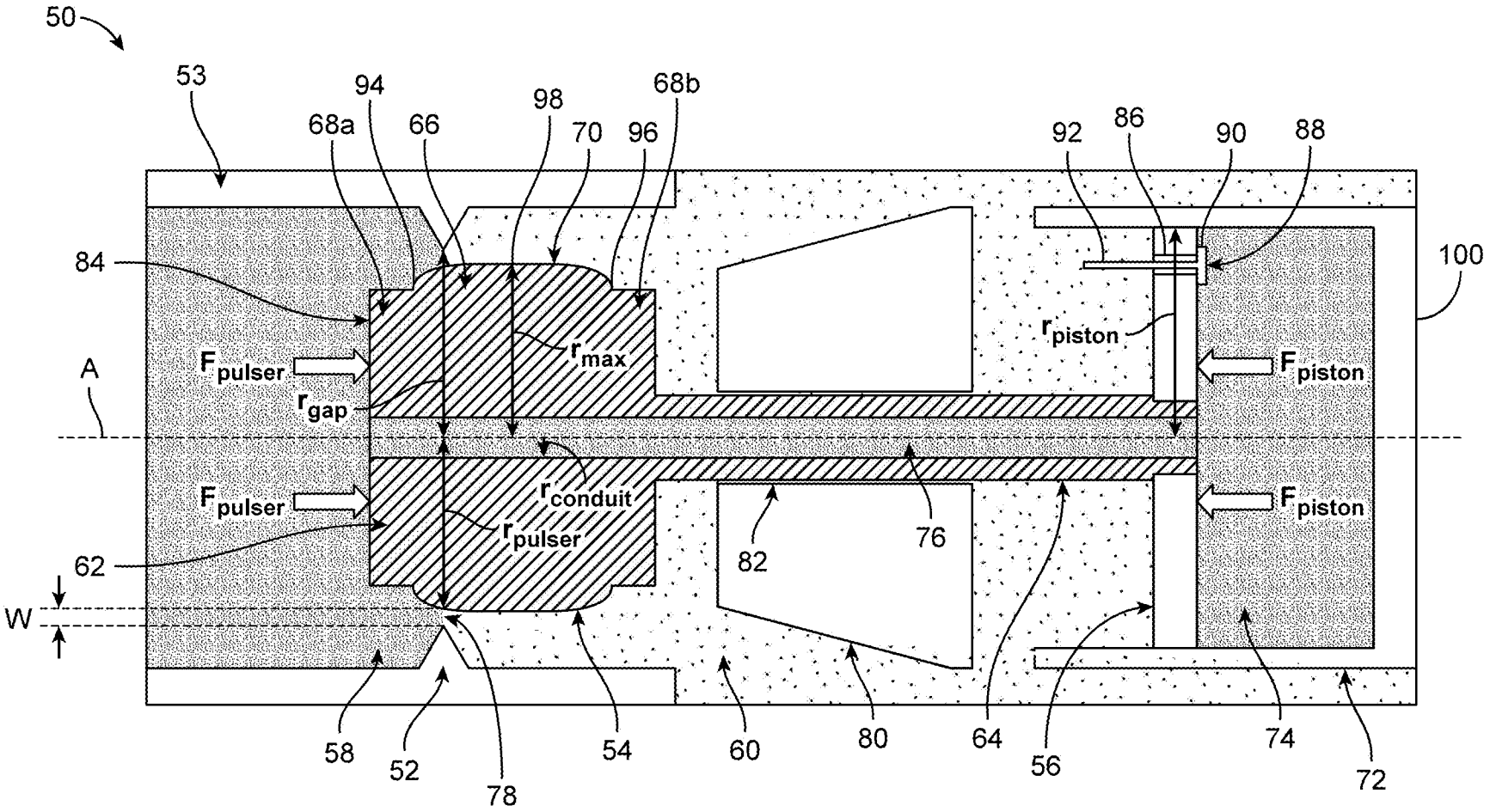
FIG. 2 illustrates a schematic view of a mud pulse telemetry system.

As shown in FIG. 2, a mud pulse telemetry system 50 may include a restriction 52 designed to generate a pressure differential, a pulser 54 supported for axial motion within the drill string 18, and a piston 56 configured to drive the axial motion of the pulser 54. The restriction 52 may be connected to a collar 53 positioned within the drill string 18 (FIG. 1) and extending at least partially therethrough. For example, the collar 53 may be substantially concentric and/or coaxial with the drill string 18 (e.g., mud flowing into the drill string 18 may be directed through the collar 53 before reaching the drill bit 24). The restriction 52 may be formed integrally with the collar 53 or may be coupled to the collar 53 and extend inwardly therefrom.

In the illustrated embodiment, the restriction 52 is provided in the form of a knife-edge restriction with an annular edge protruding inwardly from the collar 53. In other embodiments, the restriction 52 may be provided in another form (e.g., a venturi, rounded protrusion, parabolic curve, etc.), provided that the restriction 52 produces a pressure differential as mud flows through the drill string 18 to the drill bit 24 (FIG. 1) via the collar 53. As shown in FIG. 2, the restriction 52 generates a high pressure region 58 uphole relative to the restriction 52 and a low pressure region 60 downhole relative to the restriction 52 when mud is fed through the collar 53.

The pulser 54 may be positioned within the collar 53 and supported for axial movement within the drill string 18. For example, the pulser 54 may be capable of bi-directional motion along a central longitudinal axis A of the drill string 18. The pulser 54 may include a pulser body 62 and a tubular pulser stem 64 connected to the pulser body 62 and extending outwardly therefrom. The pulser stem 64 may be coupled to the piston 56 at an end of the pulser stem 64 positioned opposite the pulser body 62. Thus, the pulser 54 may be configured to move with the piston 56.

In the embodiment of FIG. 2, the pulser body 62 may include a central active region 66 and two dwell regions 68 positioned on opposing sides of the active region 66. For example, the pulser body 62 may include a first dwell region 68*a* positioned within or adjacent to the high pressure region 58 and a second dwell region 68*b* positioned within or adjacent to the low pressure region 60. The dwell regions 68*a*, 68*b* may be substantially cylindrical (e.g., the dwell regions 68*a*, 68*b* may have a constant width or radius), whereas the active region 66 may be defined by a rounded active outer surface 70.

The piston 56 may be disposed within a piston barrel 72 positioned downhole with respect to the restriction 52 and the pulser 54. The piston barrel 72 may be positioned uphole with respect to the drill bit 24 (FIG. 1). A seal may be produced between the piston 56 and the piston barrel 72 such that a pressurized piston chamber 74 is formed therebetween. A central conduit 76 provided in the form of a substantially cylindrical channel extending entirely through the pulser 54 (e.g., extending through the pulser body 62 and the pulser stem 64) may facilitate fluid communication between the high pressure region 58 within the collar 53 and the piston chamber 74. For example, mud within the high pressure region 58 may flow freely into the piston chamber 74 via the conduit 76, and vice versa. In some cases, the conduit 76 may remain open during operation of the mud pulse telemetry system 50. In other cases, the conduit 76 may be selectively opened and closed during operation, for example, via a valve operated by a solenoid (not shown).

The pulser body 62 may be arranged to move past or through the restriction 52 while the mud pulse telemetry system 50 is in use. For example, at least a portion of the pulser body 62 may be positioned in the high pressure region 58 and at least a portion of the pulser body 62 may be positioned in the low pressure region 60. Thus, an annular gap 78 may be formed between the pulser body 62 and the restriction 52. For example, the gap 78 may be positioned between the active outer surface 70 of the active region 66 and the restriction 52 or between either of the dwell regions 68*a*, 68*b* and the restriction 52 depending on the position of the pulser 54.

In some cases, the mud pulse telemetry system 50 may include a bearing 80 to support the pulser 54 for axial motion within the drill string 18. For example, the bearing 80 may be substantially cylindrical or frustoconical in shape and may include a bearing opening 82 oriented along the axis A and configured to receive and support a portion of the pulser stem 64. Alternatively, the bearing 80 may be provided in another form and may be configured to support axial motion of the pulser 54 in another manner.

Mud may flow through the gap 78 as it is driven downhole to the drill bit 24 (FIG. 1) and the restriction 52 may limit the flow of mud through the gap 78 such that a pressure differential is maintained between the high pressure region 58 and the low pressure region 60. For example, the gap 78 may at a given moment in time be defined by a gap width W. As will be appreciated by those skilled in the art, if the gap width W increases, the rate of flow through the gap 78 will increase and the pressure differential between the high pressure region 58 and the low pressure region 60 will decrease. If the gap width W decreases, the rate of flow through the gap 78 will decrease and the pressure differential between the high pressure region 58 and the low pressure region 60 will increase.

The pressure differential created by the restriction 52 may cause the mud within the collar 53 to apply a downhole force to a pressure bearing surface 84 of the pulser body 62. For example, the pressure bearing surface 84 may be an end surface of the pulser body 62 positioned in the high pressure region 58. The force acting on the pressure bearing surface 84 ($F_{pulser}$) may be proportional to the annular cross-sectional area of the portion of the pulser body 62 positioned within the restriction 52 ($A_{pulser}$). The pulser area $A_{pulser}$ can be estimated using a pulser radius ($r_{pulser}$) defined by the distance between the axis A and the outer edge of the portion of the pulser body 62 positioned within the restriction 52 and the conduit radius ($r_{conduit}$) defined by the distance between the axis A and the outer wall of the conduit 76.

The force acting on the pressure bearing surface 84 may also depend on the pressure differential ($p_o$) across the restriction 52 (e.g., the differential in pressure between the high pressure region 58 and the low pressure region 60). The pressure differential $p_o$ can be estimated using the flow rate of mud flowing into the collar 53 (Qin), the mud weight or density, and the area of the gap 78 ($A_{gap}$) formed between the restriction 52 and the pulser 54. For example, the pressure differential $p_o$ may be proportional to the inflow rate Qin and the mud density and may be inversely proportional to the gap area $A_{gap}$. Once the pulser area $A_{pulser}$ and the pressure differential $p_o$ are known (or have been estimated), the product of the two provides a measure of the pulser force $F_{pulser}$ acting on the pressure bearing surface 84.

The conduit 76 may permit pressurized mud from the high pressure region 58 to flow into the piston chamber 74 and increase the localized pressure therein. Thus, the mud within the piston chamber 74 may apply an uphole force to the piston 56 ($F_{piston}$). When the pressure differential $p_o$ created by the restriction 52 is greater than the pressure within the piston chamber 74 ($p_c$), there will be a flow of mud into the piston chamber 74 via the conduit 76 ($Q_{conduit}$). The conduit flow $Q_{conduit}$ depends on the area of the conduit 76 ($A_{conduit}$), which can be calculated using the conduit radius $r_{conduit}$.

The conduit flow $Q_{conduit}$ through the conduit 76 can be estimated based on the piston chamber pressure $p_c$, the pressure differential $p_o$ across the restriction 52, the mud density, and the cross-sectional conduit area $A_{conduit}$. For example, the conduit flow $Q_{conduit}$ may be proportional to the conduit area $A_{conduit}$ and to the difference between the pressure differential $p_o$ and the chamber pressure $p_c$.

When the piston chamber 74 is sealed, the conduit flow $Q_{conduit}$ may be positive and mud may flow into the piston chamber 74 via the conduit 76. The conduit flow $Q_{conduit}$ may result in a piston force $F_{piston}$ acting on the piston 56 and causing the piston 56 (along with the pulser 54) to move uphole. The piston 56 may move uphole with a velocity (V) that depends on the conduit flow $Q_{conduit}$ and the cross-sectional area of the piston 56 ($A_{piston}$). The piston area $A_{piston}$ can be calculated based on the conduit radius $r_{conduit}$ and the radius of the piston measured between the axis A and the piston barrel 72 ($r_{piston}$).

When the conduit flow $Q_{conduit}$ and the piston area $A_{piston}$ are known (or have been estimated), the ratio between the two provides a measure of the velocity V of the piston 56 as the piston 56 moves uphole. For example, the velocity V may be proportional the conduit flow $Q_{conduit}$ and may be inversely proportional to the piston area $A_{piston}$.

The uphole piston force $F_{piston}$ may be opposed by the downhole pulser force $F_{pulser}$. Thus, the piston force $F_{piston}$ is capable of overcoming the pulser force $F_{pulser}$ in order to move the pulser 54 uphole. To that end, the piston 56 may be constructed such that the cross-sectional piston area $A_{piston}$ is at least 1.4 times greater than the maximum value of the cross-sectional pulser area $A_{pulser}$. For example, the pulser body 62 may be defined by a maximum pulser radius Imax, which may correspond to a maximum value of the pulser area $A_{pulser}$. Therefore, the piston radius piston may be sufficiently larger that the piston area $A_{piston}$ is at least 1.4 times greater than the pulser area $A_{pulser}$ at the maximum pulser radius Imax.

As mentioned above, when the piston chamber 74 is sealed, the velocity V of the piston 56 is proportional to the conduit flow $Q_{conduit}$ into the piston chamber 74, and the conduit flow $Q_{conduit}$ into the piston chamber 74 is proportional to the pressure differential $p_o$ created by the restriction 52. Thus, a change in the size of the gap 78 may result in an acceleration or deceleration of the piston 56 and the pulser 54. For example, if the gap width W decreases and the pressure differential $p_o$ increases, the piston 56 may accelerate (i.e., the velocity V may increase). As the gap width W increases and the pressure differential $p_o$ decreases, the piston 56 may decelerate (i.e., the velocity V may decrease).

The piston 56 may include a piston opening 86 configured to release fluid within the piston chamber 74 and a piston valve 88 arranged to selectively open and close the piston opening 86. For example, the piston opening 86 may be arranged to release at least a portion of the chamber pressure $p_c$ within the piston chamber 74 by facilitating fluid communication between the piston chamber 74 and the low pressure region 60. When the piston valve 88 is closed, the piston chamber 74 may be sealed (e.g., mud may be incapable of escaping the piston chamber 74 except via the conduit 76) and the chamber pressure $p_c$ may be determined by the flow $Q_{conduit}$ through the conduit 76. When the piston valve 88 is opened, pressurized mud from within the piston chamber 74 may escape to the low pressure region 60 via the piston opening 86, thereby reducing the chamber pressure $p_c$. The flow of mud leaving the piston chamber 74 via the piston opening 86 ($Q_{out}$) can be estimated based on the cross-sectional area of the piston opening 86 (Apo), the mud density, the piston chamber pressure $p_c$, and the pressure within the low pressure region 60 (Plow). For example, the out flow $Q_{out}$ may be proportional to the piston opening area Apo and may be inversely proportional to the difference between the chamber pressure $p_c$ and the pressure plow in the low pressure region 60.

The total net flow of mud entering or exiting the piston chamber 74 ($Q_{net}$) at a given time can be estimated based on the difference between the conduit flow $Q_{conduit}$ through the conduit 76 and the out flow $Q_{out}$ from the piston chamber 74 to the low pressure region 60 via the piston opening 86. Thus, regardless of whether the piston chamber 74 is sealed (e.g., regardless of whether the piston valve 88 is open or closed), the velocity V of the piston 56 can be estimated based on the ratio between the total net flow $Q_{net}$ into or out of the piston chamber 74 and the piston area $A_{piston}$. For example, the velocity V may be proportional to the net flow $Q_{net}$ and may be inversely proportional to the piston area $A_{piston}$.

The piston valve 88 may be operable such that the pulser 54 undergoes cyclical axial motion along the axis A and sends a continuous pressure wave (e.g., a carrier wave) uphole via the column of mud in the drill string 18 while the mud pulse telemetry system 50 is in use. When the piston valve 88 is closed, the conduit flow $Q_{conduit}$ of mud into the piston chamber 74 may cause the piston force $F_{piston}$ to overcome the pulser force $F_{pulser}$ and move the pulser 54 uphole. When the pulser 54 reaches a desired uphole position, the piston valve 88 may be opened such that the out flow $Q_{out}$ through the piston opening 86 reduces the pressure within the piston chamber 74. At that point, the pulser force $F_{pulser}$ may overcome the piston force $F_{piston}$ and cause the piston 56 to return (e.g., move downhole). When the pulser 54 reaches a desired downhole position, the piston valve 88 may be closed and the process may restart.

In some cases, opening and closing of the piston valve 88 may be achieved by manual or digital intervention. For example, the mud pulse telemetry system 50 may include a solenoid (not shown) configured to open and close the piston valve 88 via an electromagnetic field. The solenoid may be operated manually by an operator or digitally by an automated computer program. Alternatively, the piston valve 88 may be controlled via another manner.

In other cases, opening and closing of the piston valve 88 may be achieved via a self-actuating mechanism (e.g., the piston valve 88 may be operable without external intervention). In other words, the cyclical motion of the piston 56 itself may cause the piston valve 88 to open and close at a desired interval. For example, the piston valve 88 may include a valve cap 90 positioned within the piston chamber 74 and a valve stem 92 connected to the valve cap 90 and extending through the piston opening 86 and into the low pressure region 60. When the piston valve 88 is closed (e.g., when the valve cap 90 contacts or is adjacent to the piston 56), the piston 56 may move uphole until the valve stem 92 contacts another internal component of the mud pulse telemetry system 50. In the example of FIG. 2, the bearing 80 is arranged to impact the valve stem 92 and open the piston valve 88 as the piston 56 continues to move uphole (e.g., by pushing the valve cap 90 away from the piston 56). Once the piston valve 88 is open, at least a portion of the pressure within the piston chamber 74 may be released and the pulser 54 may return to its downhole position. The piston valve 88 may remain open as the piston 56 moves downhole until the piston valve 88 impacts the piston barrel 72 such that the valve cap 90 moves back into contact with the piston 56, thereby closing the piston valve 88. Once the piston valve 88 is closed again, the cycle restarts.

Uphole motion of the pulser 54 may increase the pressure in the high pressure region 58 and downhole motion of the pulser 54 may decrease the pressure in the high pressure region 58. The pressure in the high pressure region 58 may be substantially equal to or may correspond to the pressure detected by pressure sensors at or above the surface. Thus, cyclical axial motion of the pulser 54 along the axis A may send a pressure wave (e.g., a carrier wave) uphole by producing cyclical fluctuations in the pressure within the high pressure region 58 that can be detected uphole and decoded (e.g., plotted on a graph) for interpretation.

Figure 3:
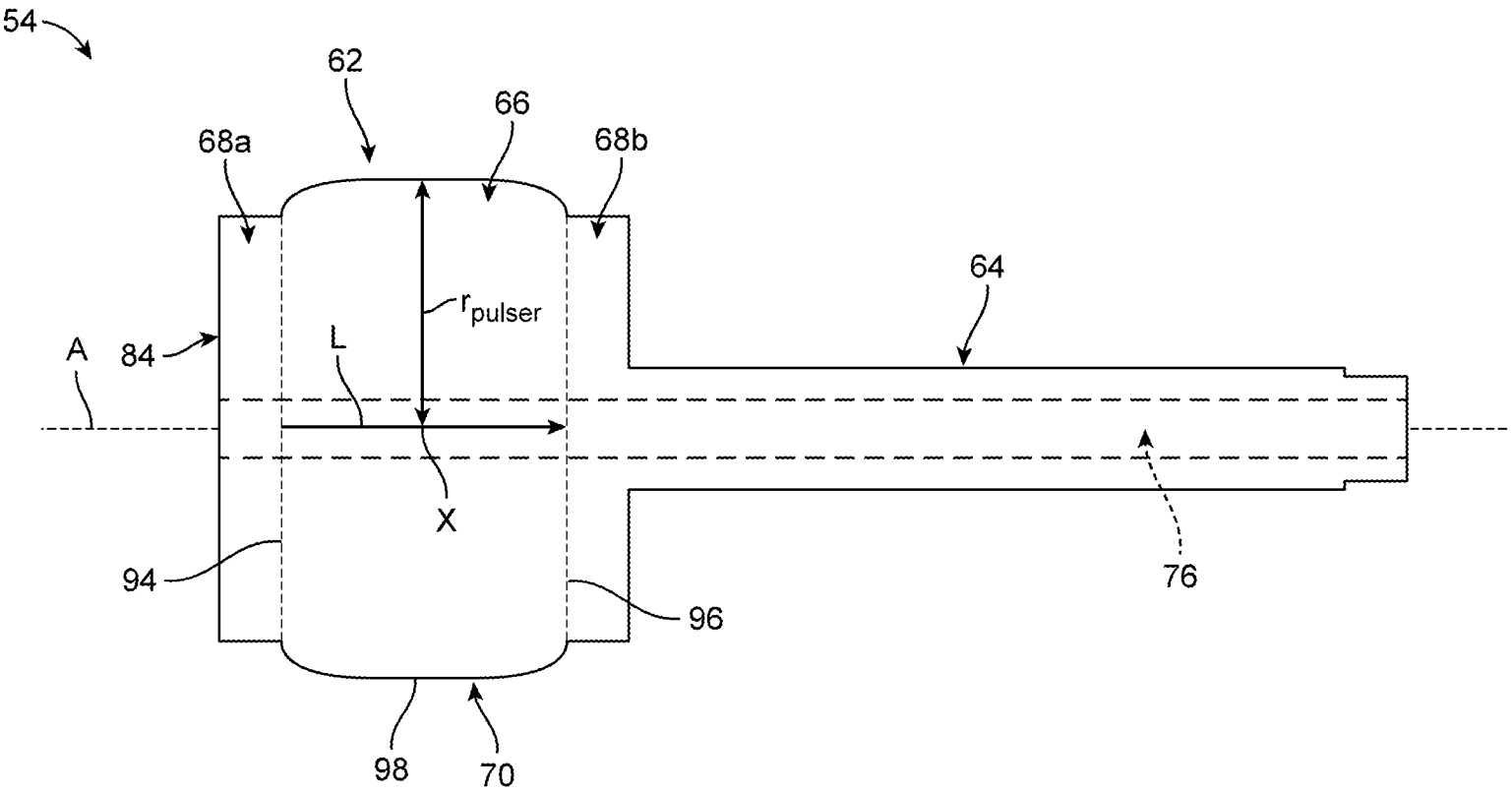
FIG. 3 illustrates a side elevational view of a pulser of the mud pulse telemetry system of FIG. 2.

Turning to FIG. 3, the pulser 54 may be imparted with a geometry designed to produce a sinusoidal pressure wave as the pulser 54 undergoes cyclical axial motion along the axis A. In an incompressible system, the force causing the piston 56 to move the pulser 54 (e.g., the pulser force $F_{pulser}$ or the piston force $F_{piston}$) will generate a constant velocity rather than an acceleration if the force is constant. For example, when the pressure detected at the surface is graphed, a constant uphole motion of the pulser 54 is represented by a straight line with a positive slope and a constant downhole motion of the pulser 54 is represented by a straight line with a negative slope.

However, acceleration of the pulser 54 is required in order to produce a sinusoidal waveform. For example, when the pressure detected at the surface is graphed, an accelerating uphole motion of the pulser 54 is represented by an upwardly curving line with a positive slope, a decelerating uphole motion of the pulser 54 is represented by a downwardly curving line with a positive slope, an accelerating downhole motion of the pulser 54 is represented by an upwardly curving line with a negative slope, and a decelerating downhole motion of the pulser 54 is represented by a downwardly curving line with a negative slope. The geometry of the active region 66 of the pulser body 62 may be tailored to produce a desired acceleration of the pulser 54 as the pulser 54 moves axially along the axis A such that, when the pressure detected at the surface is graphed, a sinusoidal (or a pseudo-sinusoidal) waveform results.

As shown in FIG. 3, the active region 66 may extend across a length L measured linearly between an active region first end 94 and an active region second end 96. The active outer surface 70 of the active region 66 may be defined by one or more transcendental functions. For purposes of this description, transcendental functions may include exponential equations, logarithmic equations, trigonometric equations, and combinations thereof. In some embodiments, the active outer surface 70 of the active region 66 may be defined by or may substantially mirror the shape of one or more logarithmic curves. For example, a position x may represent a point along the length of the active region 66 between the active region first end 94 and the active region second end 96 (i.e., x=0 at the active region first end 94 and x=L at the active region second end 96). The shape of the active region 66 may be determined by estimating the piston radius $r_{piston}$ at each position x (where 0<x<L) according to the piecewise function:

$$r_{piston} = a\ \log_{10}(x) + bx^2 + \frac{c}{x} + d \text{ where } 0 > x > \frac{L}{2}$$

$$r_{piston} = a\ \log_{10}(1-x) + b(1-x)^2 + \frac{c}{1-x} + d \text{ where } \frac{L}{2} > x > L$$

The active outer surface 70 may be shaped such that the pulser radius $r_{pulser}$ is greater at a center point 98 of the active region 66 (e.g., where x=L/2) than the pulser radius $r_{pulser}$ at the active region first end 94 and the active region second end 96. For example, the pulser radius $r_{pulser}$ may have a maximum value at the center point 98 and may decrease moving from the center point 98 to each of the active region first end 94 and the active region second end 96. Thus, the gap width W of the gap 78 between the pulser body 62 and the restriction 52 (FIG. 2) may fluctuate as the pulser 54 moves along the axis A (e.g., as the active region 66 moves back and forth within the restriction 52).

Figure 4:
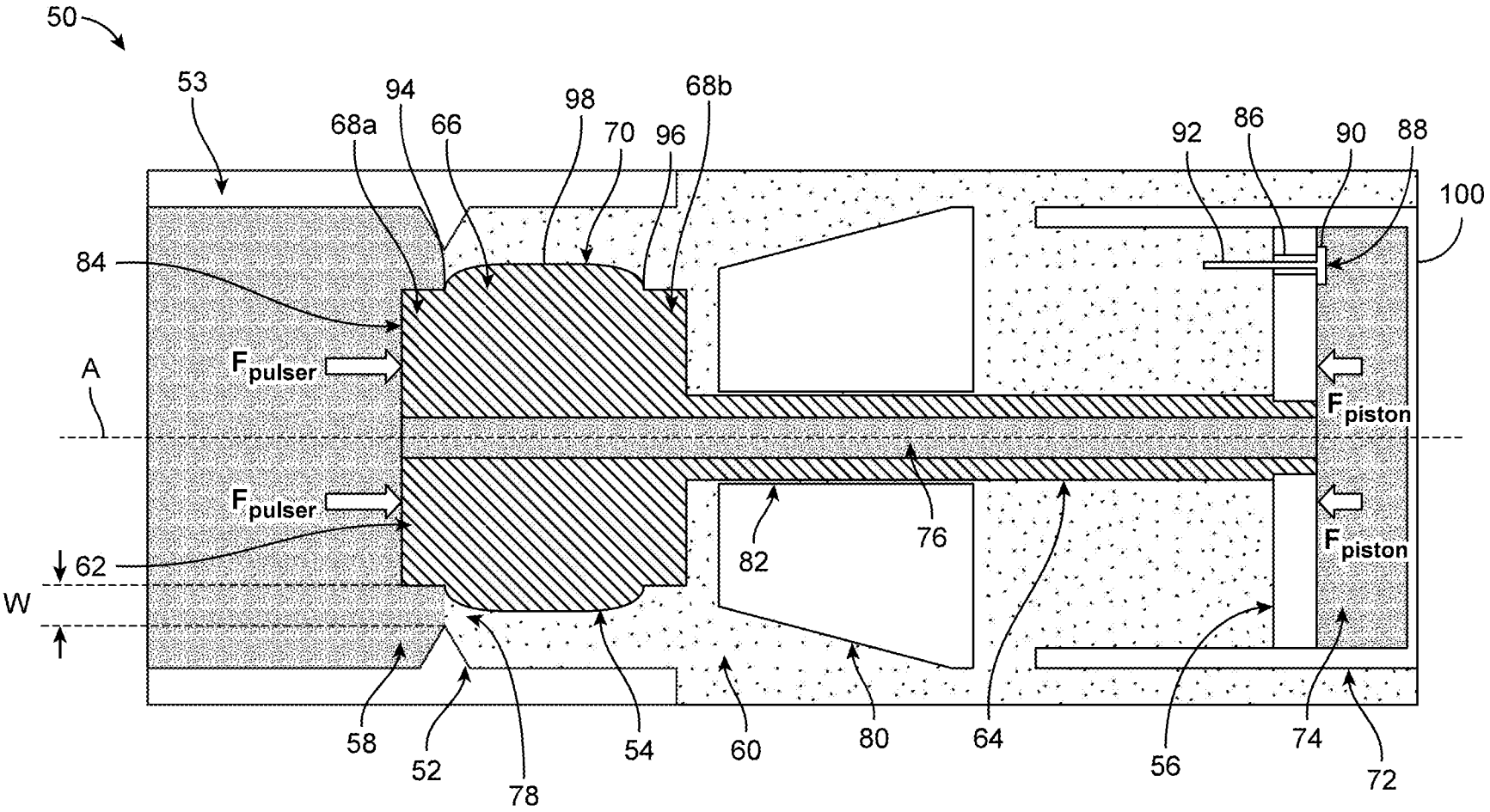
FIG. 4 illustrates a schematic view of the mud pulse telemetry system of FIG. 2 in a first stage of operation.
Figure 5:
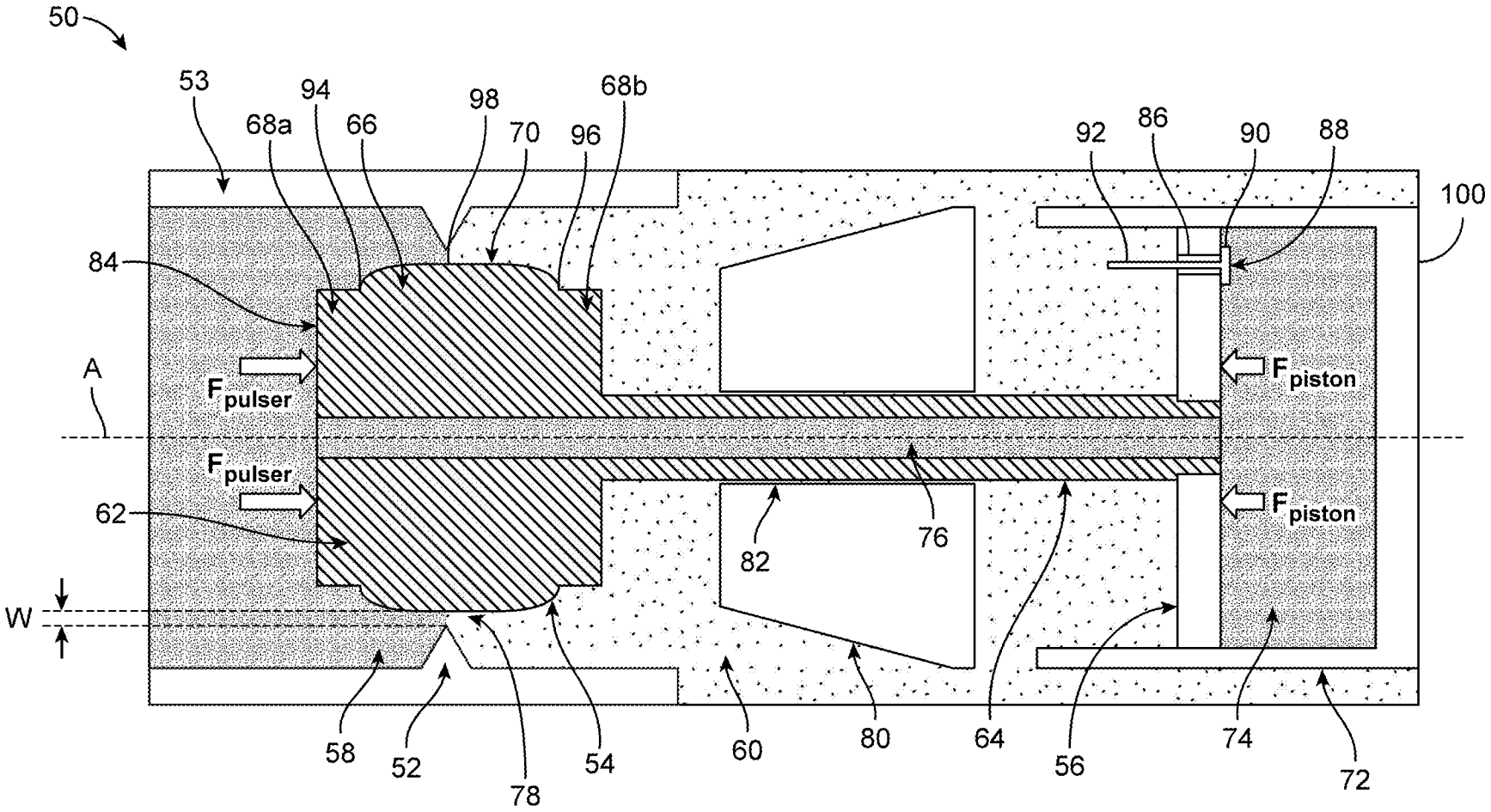
FIG. 5 illustrates a schematic view of the mud pulse telemetry system of FIG. 2 in a second stage of operation.
Figure 6:
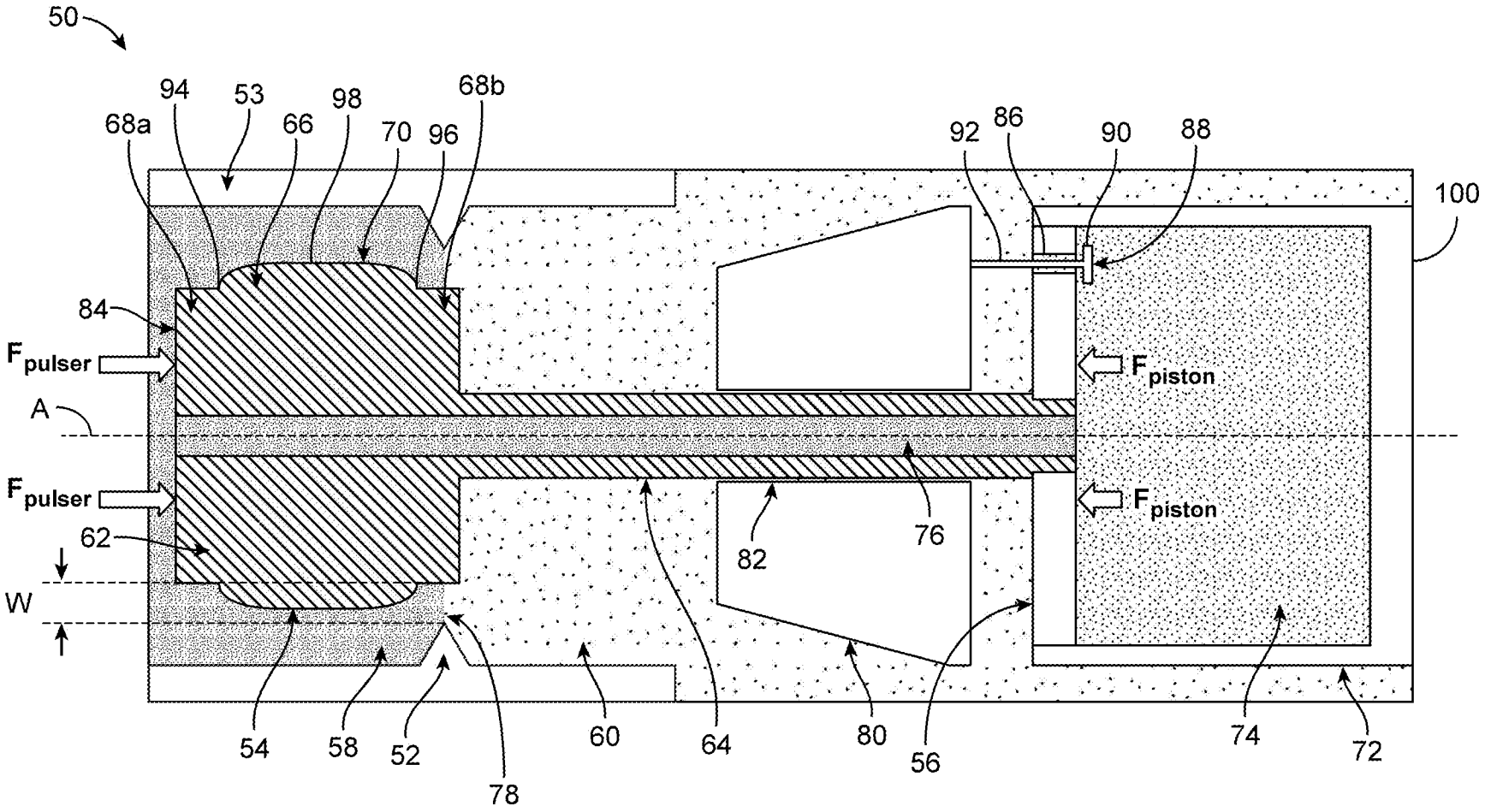
FIG. 6 illustrates a schematic view of the mud pulse telemetry system of FIG. 2 in a third stage of operation.

As shown in FIGS. 4-6, the pulser 54 may be supported for movement along the axis A between a downhole position and an uphole position during operation of the mud pulse telemetry system 50. Referring first to FIG. 4, when the pulser 54 is in the downhole position, the piston 56 may be positioned proximate to a bottom end 100 of the piston barrel 72 and the first dwell region 68*a* may be positioned within the restriction 52. In this position, the gap width W of the gap 78 may be imparted with a first gap width value, and the pressure differential $p_o$ across the restriction 52 may be imparted with a first pressure differential value.

With the pulser 54 in the downhole position, closing the piston valve 88 may cause the piston force $F_{piston}$ to move the piston 56 away from the bottom end 100, causing the pulser 54 to move uphole. As the pulser 54 leaves the downhole position, the center point 98 of the active region 66 approaches the restriction 52 the pulser radius $r_{pulser}$ of the portion of the pulser body 62 positioned within the restriction 52 increases, thereby causing the gap width W to decrease. As a result, the flow through the gap 78 becomes more restricted and the pressure differential $p_o$ across the restriction 52 increases. As the pressure differential $p_o$ increases, the flow $Q_{conduit}$ of mud into the piston chamber 74 increases, causing the piston force $F_{piston}$ to increase and the motion of the pulser 54 uphole to accelerate.

The pulser 54 may occupy a middle position, shown in FIG. 5, when the center point 98 of the active region 66 is positioned within the restriction 52. When the pulser 54 is in the middle position, the gap width W may be imparted with a second gap width value greater than the first gap width value, and the pressure differential $p_o$ across the restriction 52 may be imparted with a second pressure differential value less than the first pressure differential value.

As the pulser 54 leaves the middle position and continues to move uphole, the center point 98 moves away from the restriction 52 and the active region second end 96 approaches the restriction 52. As the active region second end 96 approaches the restriction 52, the pulser radius $r_{pulser}$ of the portion of the pulser body 62 positioned within the restriction 52 decreases, thereby causing the gap width W to increase. As a result, the flow through the gap 78 becomes less restricted and the pressure differential $p_o$ across the restriction 52 decreases. As the pressure differential $p_o$ decreases, the flow $Q_{conduit}$ of mud into the piston chamber 74 decreases, causing the piston force $F_{piston}$ to decrease and the motion of the pulser 54 uphole to decelerate.

The pulser 54 may move uphole until the pulser 54 reaches the uphole position, shown in FIG. 6. When the pulser 54 is in the uphole position, the gap width W may be imparted with a third gap width value greater than the second gap width value, and the pressure differential $p_o$ may be imparted with a third pressure differential value greater than the second pressure differential value. In some cases, the first gap width value may be substantially equal to the third gap width value, and the first pressure differential value may be substantially equal to the third pressure differential value.

When the pulser 54 reaches the uphole position, the piston valve 88 may be opened to release at least a portion of the pressure within the piston chamber 74. Opening the piston valve 88 may reduce the piston force $F_{piston}$ pushing the piston 56 uphole such that the pulser force $F_{pulser}$ takes over and causes the pulser 54 to return to the downhole position. As the pulser 54 returns to the downhole position, the active outer surface 70 passes back through the restriction 52 such that fluctuations in the gap width W cause the pulser 54 to accelerate and decelerate in the manner described above.

The magnitude of the change in pressure within the column of mud inside the drill string 18 may correspond to the velocity of the pulser 54. For example, if the pulser 54 moves uphole at a constant velocity V, the pressure within the drill string 18 will increase at a constant rate. However, if the pulser 54 moves uphole at an increasing velocity V (e.g., accelerates), the pressure within the drill string 18 will increase at an increasing rate. If the pulser 54 moves uphole at a decreasing velocity V (e.g., decelerates), the rate of increase of pressure within the drill string 18 will slow. Likewise, if the pulser 54 moves downhole at a constant velocity V, the pressure within the drill string 18 will decrease at a constant rate. However, if the pulser 54 moves downhole at an increasing velocity V (e.g., accelerates), the pressure within the drill string 18 will decrease at a faster rate. If the pulser 54 moves downhole at a decreasing velocity V (e.g., decelerates), the pressure within the drill string will decrease at a decreasing rate.

In this way, by controlling the opening and closing of the piston valve 88, the cyclical motion of the pulser 54 within the drill string 18 may be modulated such that the resulting pressure wave detected uphole is sinusoidal (e.g., as opposed to a square, trapezoidal, or other irregularly shaped pressure wave). For example, the mud pulse telemetry system 50 may be configured to produce a carrier wave in the form of a sinusoidal pressure wave 102 or a pseudo-sinusoidal pressure wave 104, as shown in FIG. 7.

Figure 7:
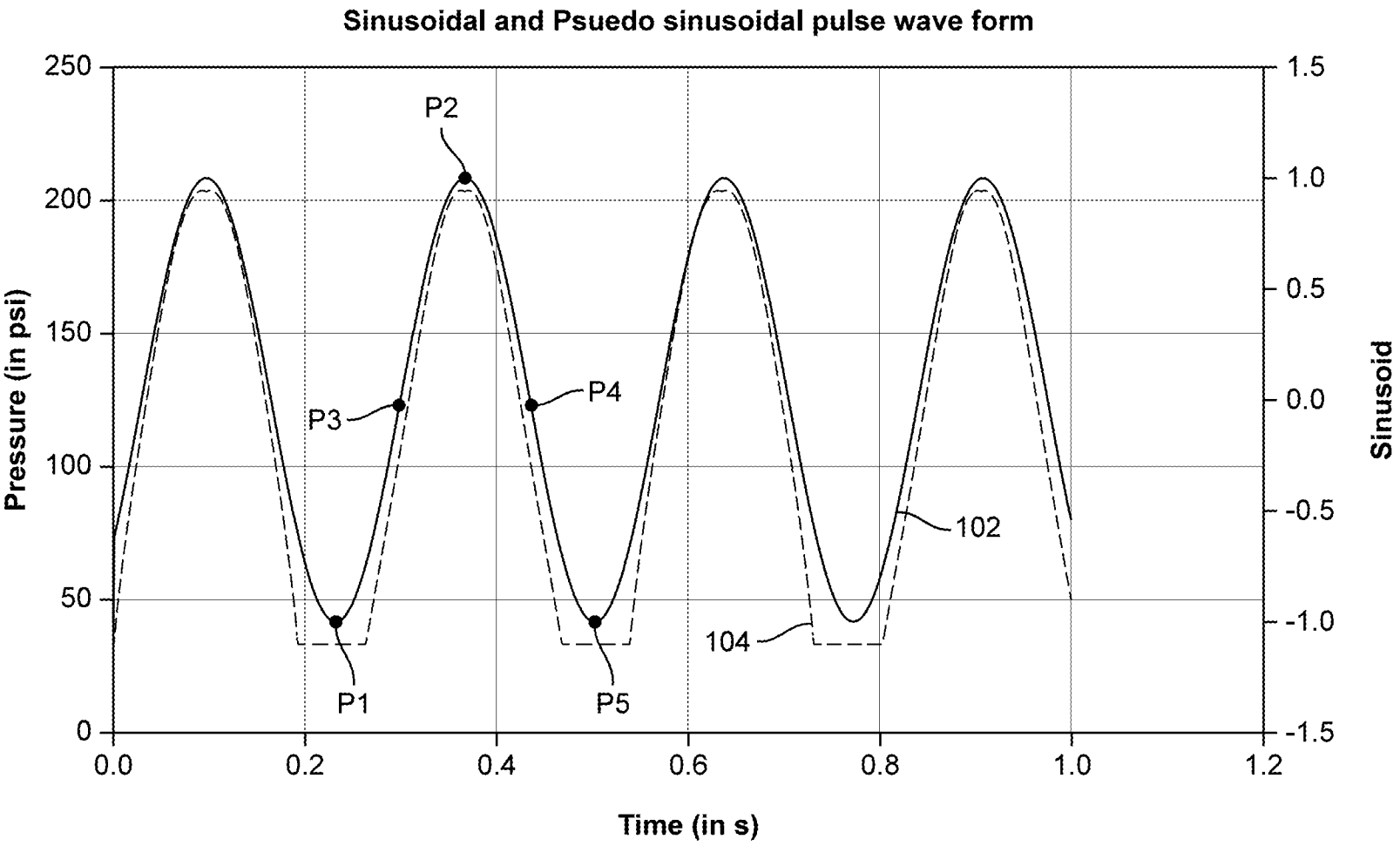
FIG. 7 illustrates a graphical representation of a pressure wave generated by the mud pulse telemetry system of FIG. 2.

With reference to the sinusoidal pressure wave 102 shown in FIG. 7, each point along the sinusoidal pressure wave 102 may correspond to an associated position of the pulser 54 with respect to the restriction 52. For example, a first point P1 corresponding to a minimum detected pressure within the high pressure region 58 (e.g., FIG. 2) may correspond to the downhole position of the pulser 54 (FIG. 4). The piston valve 88 may be closed at or around the first point P1. A second point P2 may correspond to the middle position of the pulser 54 (FIG. 5) as the pulser 54 travels uphole. A third point P3 corresponding to a maximum detected pressure within the high pressure region 58 may correspond to the uphole position of the pulser 54 (FIG. 6). The piston valve 88 may be opened at or around the third point P3. A fourth point P4 may correspond to the middle position of the pulser 54 (FIG. 5) as the pulser 54 travels downhole. A fifth point P5 may be associated with the return of the pulser 54 to the downhole position. The piston valve 88 may be closed at or around the fifth point P5, and the cyclical axial motion of the pulser 54 may be restarted.

In some cases, the pressure within the high pressure region 58 may remain substantially constant for a brief period while the pulser 54 occupies the downhole position and/or the uphole position. For example, the pulser 54 may be configured to remain stationary for a brief period, or one of the dwell regions 68*a*, 68*b* may be positioned within the restriction 52 such that the pressure within the high pressure region 58 remains substantially constant. In these cases, the pressure detected at the surface, when graphed, may produce the pseudo-sinusoidal pressure wave 104 rather than the sinusoidal pressure wave 102. However, the principles of operation of the mud pulse telemetry system 50 remain the same regardless of whether the resulting pressure wave is sinusoidal or pseudo-sinusoidal.

Figure 8:
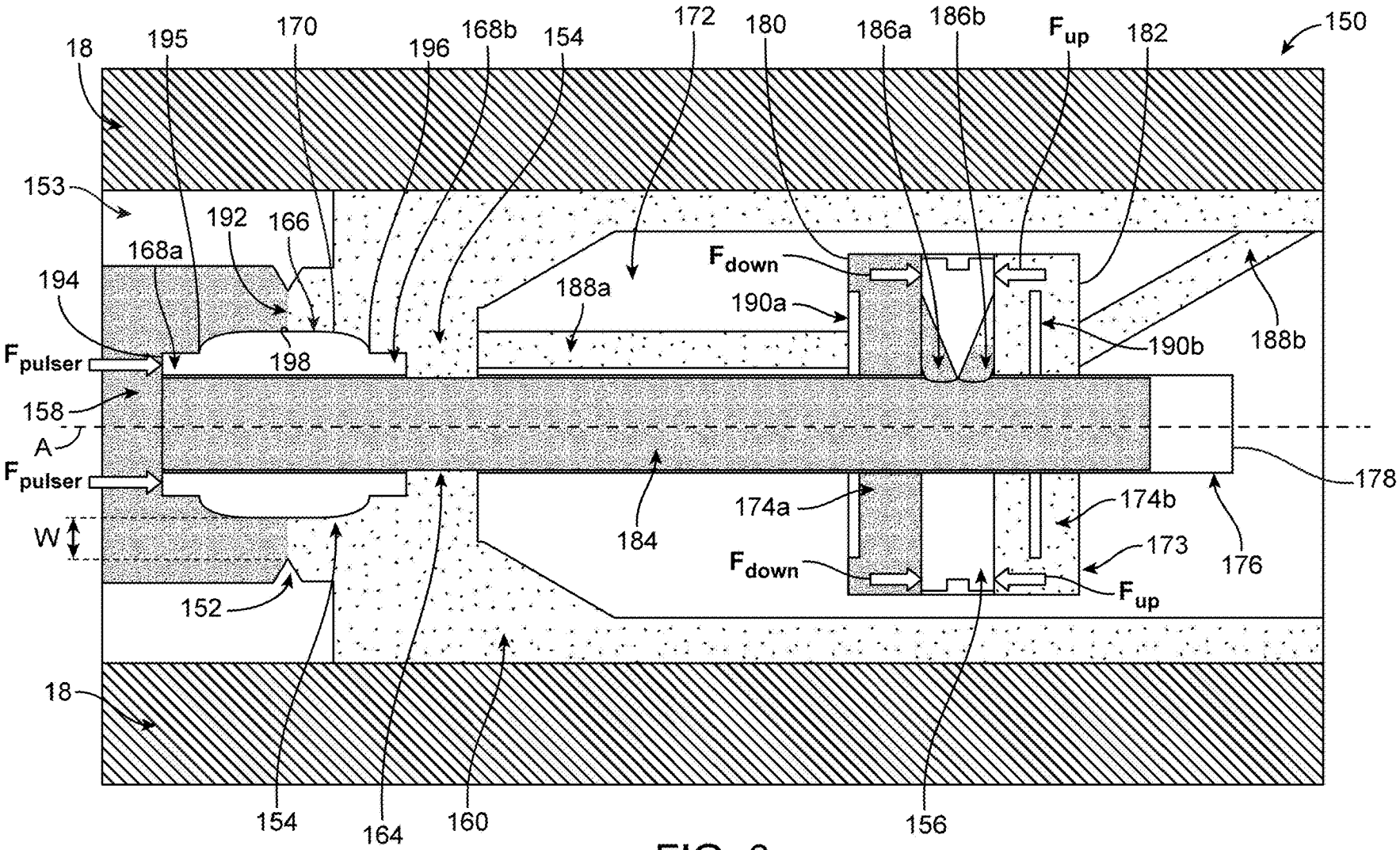
FIG. 8 illustrates a schematic view of a mud pulse telemetry system according to another embodiment.

Turning to FIGS. 8-12, another mud pulse telemetry system 150 is depicted. The mud pulse telemetry system 150 functions in a manner similar to that of the mud pulse telemetry system 50. However, the mud pulse telemetry system 150 has a slightly different structure. Referring first to FIG. 8, like the mud pulse telemetry system 50, the mud pulse telemetry system 150 includes a restriction 152 designed to generate a pressure differential, a pulser 154 supported for axial motion within the drill string 18, and a piston 156 configured to drive the axial motion of the pulser 154. The restriction 152 may be connected to a collar 153 positioned within the drill string 18 and extending therethrough. For example, the collar 153 may be substantially concentric and/or coaxial with the drill string 18 (e.g., mud flowing into the drill string 18 may be directed through the collar 153 before reaching the drill bit 24). The restriction 152 may be formed integrally with the collar 153 or may be coupled to the collar 153 and extend inwardly therefrom.

In some cases, the restriction 152 may be provided in the form of a knife-edge restriction with an annular edge protruding inwardly from the collar 153. In other embodiments, the restriction 152 may be provided in another form (e.g., a venturi, rounded protrusion, parabolic curve, etc.), provided that the restriction 152 produces a pressure differential as mud flows through the drill string 18 to the drill bit 24 (FIG. 1) via the collar 153. As shown, the restriction 152 generates a high pressure region 158 uphole relative to the restriction 152 and a low pressure region 160 downhole relative to the restriction 152 when mud is fed through the collar 153.

The pulser 154 may be positioned within the collar 153 and supported for axial movement within the drill string 18. For example, the pulser 154 may be capable of bi-directional motion along a central longitudinal axis A of the drill string 18. The pulser 154 may include a pulser body 162 and a tubular pulser stem 164 connected to the pulser body 162 and extending outwardly therefrom. The pulser stem 164 may be coupled to the piston 156 at an end of the pulser stem 164 positioned opposite the pulser body 162. Thus, the pulser 154 may be configured to move with the piston 156.

In the embodiment of FIG. 8, the pulser body 162 may include a central active region 166 and two dwell regions 168 positioned on opposing sides of the active region 166. For example, the pulser body 162 may include a first dwell region 168*a* positioned within or adjacent to the high pressure region 158 and a second dwell region 168*b* positioned within or adjacent to the low pressure region 160. The dwell regions 168*a*, 168*b* may be substantially cylindrical (e.g., the dwell regions 168*a*, 168*b* may have a constant width or radius), whereas the active region 166 may be defined by a rounded active outer surface 170.

A piston barrel 172 positioned downhole with respect to the restriction 152 and the pulser 154 and positioned uphole with respect to the drill bit 24 (FIG. 1) may be configured to retain the piston 156. For example, the piston 156 may be disposed within a substantially cylindrical cavity 173 defined by the piston barrel 172. A seal may be produced between the piston 156 and the outer wall of the cavity 173 such that the piston 156 divides the cavity 173 into a first piston chamber 174*a* (e.g., positioned uphole with respect to the piston 156) and a second piston chamber 174*b* (e.g., positioned downhole with respect to the piston 156).

For example, pulser stem 164 may extend into the piston barrel 172 and be received by a stem tunnel 176 provided in the form of cylindrical channel formed in the piston barrel 172 and oriented along the axis A. The stem tunnel 176 may extend entirely through the cavity 173 and terminate at a tunnel wall 178 positioned downhole with respect to the cavity 173. The piston 156 may be connected to a portion of the pulser stem 164 disposed within the cavity 173, and the pulser stem 164 may be configured to move linearly through the stem tunnel 176 (e.g., in an uphole and a downhole direction). Thus, the piston 156 and the pulser 154 may be configured to move together and the piston 156 may be movable between an uphole end 180 and a downhole end 182 of the cavity 173.

A central conduit 184 provided in the form of a substantially cylindrical channel extending entirely through the pulser 154 (e.g., extending through the pulser body 162 and the pulser stem 164) may facilitate fluid communication between the high pressure region 158 within the collar 153 and the cavity 173 within the piston barrel 172. For example, one or more communication pipes 186 may be connected to the central conduit 184 and may extend through the piston 156 such that each communication pipe 186 facilitates fluid communication between the central conduit 184 and the first piston chamber 174*a* and/or the second piston chamber 174*b*. In the example of FIGS. 8-12, a first communication pipe 186*a* facilitates fluid communication between the central conduit 184 and the first piston chamber 174*a*, and a second communication pipe 186*b* facilitates communication between the central conduit 184 and the second piston chamber 174*b*. Thus, mud from the high pressure region 158 may flow first into the central conduit 184 and then into the first piston chamber 174*a* and/or into the second piston chamber 174*b* via the first communication pipe 186*a* or the second communication pipe 186*b*, respectively.

The communication pipes 186 are depicted herein as segments of straight pipe protruding outwardly at an angle from the conduit 184. However, it will be appreciated by those skilled in the art that the communication pipes 186 may be imparted with any suitable size, shape, and/or structure provided that the first communication pipe 186*a* is configured to facilitate fluid communication between the conduit 184 and the first piston chamber 174*a* and the second communication pipe 186*b* is configured to facilitate communication between the conduit 184 and the second piston chamber 174*b*.

In some cases, the conduit 184 may remain open during operation of the mud pulse telemetry system 150. In other cases, the conduit 184 may be selectively opened and closed during operation, for example, via a valve operated by a solenoid (not shown). Likewise, in some cases, the first and second communication pipes 186*a*, 186*b* may remain open during operation of the mud pulse telemetry system 150. In other cases, the conduit 184 may include an internal valve assembly or control mechanism (not shown) configured to selectively control, limit, or shut off the flow of mud into the first piston chamber 174*a* via the first communication pipe 186*a* and/or the flow of mud into the second piston chamber 174*b* via the second communication pipe 186*b*.

The mud pulse telemetry system 150 may include one or more outlet pipes 188 configured to release at least a portion of the pressure within the first piston chamber 174*a* and/or the second piston chamber 174*b*. For example, a first outlet pipe 188*a* may be arranged to facilitate fluid communication between the first piston chamber 174*a* and the low pressure region 160 and a second outlet pipe 188*b* may be arranged to facilitate fluid communication between the second piston chamber 174*b* and the low pressure region 160. Additionally, in some cases, one or more plate valves 190 may be configured to selectively open and close the first and second outlet pipes 188*a*, 188*b*. For example, a first plate valve 190*a* may be positioned within the first piston chamber 174*a* and configured to selectively open and close the first outlet pipe 188*a* and a second plate valve 190*b* may be positioned within the second piston chamber 174*b* and configured to selectively open and close the second outlet pipe 188*b*. In other cases, the first and second outlet pipes 188*a*, 188*b* may be opened and closed using a valve and solenoid, or via another mechanism.

The pulser body 162 may be arranged to move past or through the restriction 152 while the mud pulse telemetry system 150 is in use. For example, at least a portion of the pulser body 162 may be positioned in the high pressure region 158 and at least a portion of the pulser body 162 may be positioned in the low pressure region 160. Thus, an annular gap 192 may be formed between the pulser body 162 and the restriction 152. For example, the gap 192 may be positioned between the active outer surface 170 of the active region 166 and the restriction 152 or between either of the dwell regions 168*a*, 168*b* and the restriction 152 depending on the position of the pulser 54.

Mud may flow through the gap 192 as it is driven downhole to the drill bit 24 (FIG. 1) and the restriction 152 may limit the flow of mud through the gap 192 such that a pressure differential is maintained between the high pressure region 158 and the low pressure region 160. For example, the gap 192 may at a given moment in time be defined by a gap width W. As will be appreciated by those skilled in the art, if the gap width W increases, the rate of flow through the gap 192 will increase and the pressure differential between the high pressure region 158 and the low pressure region 160 will decrease. If the gap width W decreases, the rate of flow through the gap 192 will decrease and the pressure differential between the high pressure region 158 and the low pressure region 160 will increase.

The pressure differential created by the restriction 152 may cause the mud within the collar 53 to apply a downhole pulser force $F_{pulser}$ to a pressure bearing surface 194 of the pulser body 162. For example, the pressure bearing surface 194 may be an end surface of the pulser body 162 positioned in the high pressure region 158. The pulser force $F_{pulser}$ may be proportional to the annular cross-sectional pulser area $A_{pulser}$ of the portion of the pulser body 162 positioned within the restriction 152. The pulser area $A_{pulser}$ can be estimated using the pulser radius $r_{pulser}$ of the portion of the pulser body 162 positioned within the restriction 152 and the conduit radius $r_{conduit}$ of the conduit 184, as described above with reference to FIG. 2.

The pulser force $F_{pulser}$ acting on the pressure bearing surface 194 may also depend on the pressure differential $p_o$ across the restriction 152. The pressure differential $p_o$ can be estimated using the in flow Qin of mud flowing into the collar 53, the mud density, and the gap area $A_{gap}$ of the gap 192. For example, the pressure differential $p_o$ may be proportional to the in flow Qin and the mud density and may be inversely proportional to the gap area $A_{gap}$. Once the pulser area $A_{pulser}$ and the pressure differential $p_o$ are known (or have been estimated), the product of the two provides a measure of the pulser force $F_{pulser}$ acting on the pressure bearing surface 194.

The conduit 184 may permit pressurized mud from the high pressure region 158 to flow into the first piston chamber 174*a* via the first communication pipe 186*a* and/or into the second piston chamber 174*b* via the second communication pipe 186*b*. Thus, the pressure of the mud within the first and second piston chambers 174*a*, 174*b* may act on the piston 156. For example, mud within the first piston chamber 174*a* may apply a downhole piston force ($F_{down}$) to the piston 156 and mud within the second piston chamber 174*b* may apply an uphole piston force ($F_{up}$) to the piston 156.

When the pressure differential $p_o$ created by the restriction 152 is greater than the pressure within the first piston chamber 174*a*, there will be a flow of mud into the first piston chamber 174*a* via the conduit 184 ($Q_{conduit,1}$). When the pressure differential $p_o$ created by the restriction 152 is greater than the pressure within the second piston chamber 174*b*, there will be a flow of mud into the second piston chamber 174*b* via the conduit 184 ($Q_{conduit,2}$). The conduit flow $Q_{conduit,1}$ into the first piston chamber 174*a* and the conduit flow $Q_{conduit,2}$ into the second piston chamber 174*b* depend on the conduit area $A_{conduit}$ of the conduit 184, which can be calculated using the conduit radius $r_{conduit}$.

The first and second plate valves 190*a*, 190*b* may be provided in the form of a shuttling mechanism configured to ensure that either the first outlet pipe 188*a* or the second outlet pipe 188*b* is closed by the associated plate valve 190 at any given time while the mud pulse telemetry system 150 is in use. For example, the first and second plate valves 190*a*, 190*b* may be movably connected to the pulser stem 164 such that the first plate valve 190*a* is slidable along the pulser stem 164 within the first piston chamber 174*a* and the second plate valve 190*b* is slidable along the pulser stem 164 within the second piston chamber 174*b*.

Alternatively, the first and second plate valves 190*a*, 190*b* may be omitted and the first and second outlet pipes 188*a*, 188*b* may each be equipped with a valve (not shown) configured to selectively open and close the first and second outlet pipes 188*a*, 188*b*. For example, the valve associated with the first outlet pipe 188*a* and the valve associated with the second outlet pipe 188*b* may each be operated by a solenoid (not shown), and the solenoids may be controlled either manually or automatically such that, at any given time, one of the first and second outlet pipes 188*a*, 188*b* is open and the other of the first and second outlet pipes 188*a*, 188*b* is closed. In other cases, flow through the first and second outlet pipes 188*a*, 188*b* may be controlled in another manner.

Figure 10:
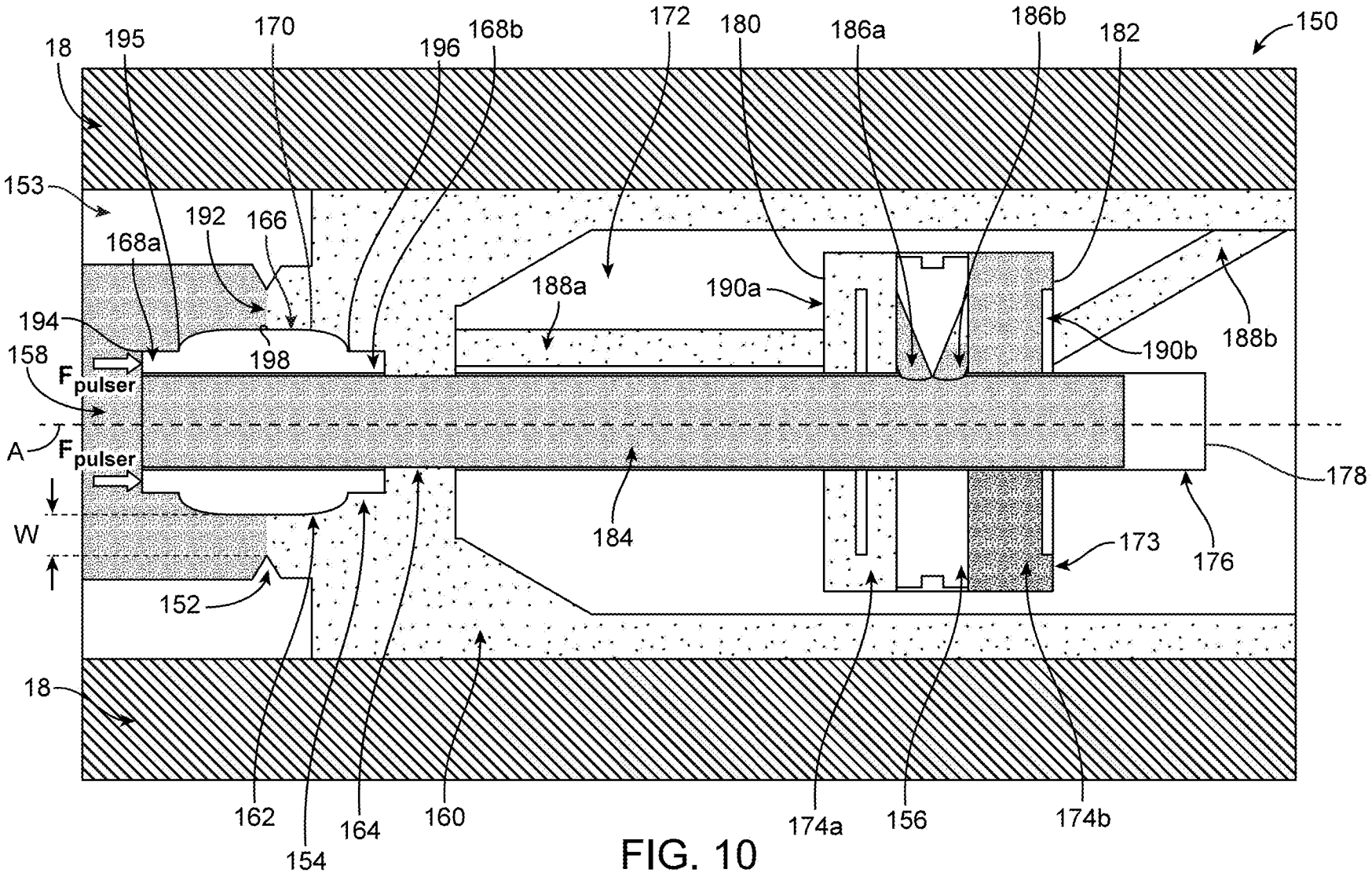
FIG. 10 illustrates a schematic view of the mud pulse telemetry system of FIG. 8 in a second stage of operation.

When the first outlet pipe 188*a* is closed and pressurized mud flows into the first piston chamber 174*a*, the second outlet pipe 188*b* may be open such that pressure within the second piston chamber 174*b* can be released to the low pressure region 160. Likewise, when the second outlet pipe 188*b* is closed and pressurized mud flows into the second piston chamber 174*b*, the first outlet pipe 188*a* may be open such that pressure within the first piston chamber 174*a* can be released to the low pressure region 160 (FIG. 10). When the first outlet pipe 188*a* is closed and the second outlet pipe 188*b* is open, pressurized mud within the first piston chamber 174*a* may cause the piston 156 and the pulser 154 to move downhole via the downhole piston force $F_{down}$. When the second outlet pipe 188*b* is closed and the first outlet pipe 188*a* is open, pressurized mud within the second piston chamber 174*b* may cause the piston 156 and the pulser 154 to move uphole via the uphole piston force $F_{up}$.

The cross-sectional area of the first outlet pipe 188*a* may be larger than the cross-sectional area of the first communication pipe 186*a* and the cross-sectional area of the second outlet pipe 188*b* may be larger than the cross-sectional area of the second communication pipe 186*b*. For example, when the first outlet pipe 188*a* is open, mud may continue to flow into the first piston chamber 174*a* via the first communication pipe 186*a*. Thus, imparting the first outlet pipe 188*a* with a larger cross-sectional area than the first communication pipe 186*a* may ensure that pressure within the first piston chamber 174*a* may be released to the low pressure region 160 despite the continuing inflow of mud via the first communication pipe 186*a*. The same dynamic may be equally applicable with respect to the second piston chamber 174*b*, the second communication pipe 186*b*, and the second outlet pipe 188*b*.

The downhole piston force $F_{down}$ may cause the piston 156 to move downhole (e.g., toward the downhole end 182 of the cavity 173) with a velocity V, and the uphole piston force $F_{up}$ may cause the piston 156 to move uphole (e.g., toward the uphole end 180 of the cavity 173) with a velocity V. The velocity V of the piston 156 may depend on the conduit flow into the first piston chamber 174*a* $Q_{conduit,1}$ and into the second piston chamber 174*b* $Q_{conduit,2}$ and the cross-sectional piston area $A_{piston}$. The piston area $A_{piston}$ can be calculated based on the conduit radius conduit and the piston radius $r_{piston}$. The piston area $A_{piston}$ of the piston 156 may be imparted with a value that is at least 1.4 times larger than the largest cross-sectional area of the plunger 154 (e.g., the cross-sectional area of the plunger 154 at the center point 198). When the conduit flows $Q_{conduit,1}$ and $Q_{conduit,2}$ and the piston area $A_{piston}$ are known (or have been estimated), the ratio between the two provides a measure of the velocity V of the piston 156. For example, the velocity V may be proportional to the conduit flows $Q_{conduit,1}$ and $Q_{conduit,2}$ and may be inversely proportional to the piston area $A_{piston}$. Additionally, the velocity V may depend on the differential between the pressure within the first piston chamber 174*a* and the pressure within the second piston chamber 174*b*.

The velocity V of the piston 156 is proportional to the conduit flow $Q_{conduit}$ into the first piston chamber 174*a* and/or the second piston chamber 174*b*, and the conduit flow $Q_{conduit}$ is proportional to the pressure differential $p_o$ created by the restriction 152. Thus, a change in the size of the gap 192 may result in an acceleration or deceleration of the piston 156 and the pulser 154. For example, if the gap width W decreases and the pressure differential $p_o$ increases, the conduit flow $Q_{conduit}$ may increase and the piston 156 may accelerate (e.g., the velocity V may increase). As the gap width W increases and the pressure differential $p_o$ decreases, the conduit flow $Q_{conduit}$ may decrease and the piston 156 may decelerate (e.g., the velocity V may decrease).

The first and second outlet pipes 188*a*, 188*b* may be operated (e.g., opened and closed) such that the pulser 154 undergoes cyclical axial motion along the axis A. Uphole motion of the pulser 154 may increase the pressure in the high pressure region 158 and downhole motion of the pulser 154 may decrease the pressure in the high pressure region 158. The pressure in the high pressure region 158 may be substantially equal to or may correspond to the pressure detected by pressure sensors at or above the surface. Thus, cyclical axial motion of the pulser 154 along the axis A may send a pressure wave (e.g., a carrier wave) uphole by producing cyclical fluctuations in the pressure within the column of mud in the drill string 18 that can be detected uphole and decoded (e.g., plotted on a graph) for interpretation while the mud pulse telemetry system 150 is in use.

Like the pulser 54, the pulser 154 may be imparted with a geometry designed to produce a sinusoidal pressure wave as the pulser 154 undergoes cyclical axial motion along the axis A. For example, the geometry of the active region 166 of the pulser body 162 may be tailored to produce a desired acceleration of the pulser 154 such that, when the pressure detected at the surface is graphed, a sinusoidal (or a pseudo-sinusoidal) waveform results (FIG. 7). In particular, the active outer surface 170 of the active region 166 may be defined by or may substantially mirror the shape of one or more logarithmic curves, as described in detail above with reference to FIG. 3.

Thus, the active region 166 may extend between an active region first end 195 and an active region second end 196, and the pulser radius $r_{pulser}$ may have a maximum value at a center point 198 positioned between the active region first and second ends 195, 196. Accordingly, the gap width W of the gap 192 between the pulser body 162 and the restriction 152 (FIG. 2) may fluctuate as the pulser 154 moves along the axis A (e.g., as the active region 166 moves back and forth within the restriction 152).

When the first outlet pipe 188*a* is closed, mud may flow into the first piston chamber 174*a* via the first communication pipe 186*a* (e.g., increasing the local pressure therein) and mud may flow out of the second piston chamber 174*b* via the second outlet pipe 188*b* (e.g., releasing at least a portion of the local pressure therein). As a result, the downhole piston force $F_{down}$ applied by the pressurized mud within the first piston chamber 174*a* may cause the piston 156 and the pulser 154 to move downhole (e.g., decreasing the pressure within the column of mud inside the drill string 18).

Likewise, when the second outlet pipe 188*b* is closed, mud may flow into the second piston chamber 174*b* via the second communication pipe 186*b* (e.g., increasing the local pressure therein) and mud may flow out of the first piston chamber 174*a* via the first outlet pipe 188*a* (e.g., releasing at least a portion of the local pressure therein). As a result, the uphole piston force $F_{up}$ applied by the pressurized mud within the second piston chamber 174*b* may cause the piston 156 and the pulser 154 to move uphole (e.g., increasing the pressure within the column of mud inside the drill string 18). In some embodiments, a biasing spring (not shown) may be positioned within the second piston chamber 174*b* and configured to supplement the uphole piston force $F_{up}$ (e.g., to help oppose the downhole piston force $F_{down}$) by applying an uphole force to the piston 156. For example, the biasing spring may be positioned in a compressed state between the piston 156 and the interior surface of the second piston chamber 174*b* opposing the piston 156 such that outward expansion of the biasing spring pushes the piston 156 uphole.

The cyclical motion of the pulser 154 may be altered or influenced by the structure (e.g., the size) of the first and second outlet pipes 188*a*, 188*b*. The first and second outlet pipes 188*a*, 188*b* are depicted in FIG. 8 as being substantially the same size. However, in some embodiments, the first outlet pipe 188*a* and the second outlet pipe 188*b* may have different sizes. For example, the first outlet pipe 188*a* may be imparted with a first radius and the second outlet pipe 188*b* may be imparted with a second radius that is either less than or greater than the first radius of the first outlet pipe 188*a*. Altering the size of the first and second outlet pipes 188*a*, 188*b* may influence the flow of fluid into and out of the first and second piston chambers 174*a*, 174*b*, respectively, such that tuning the size (e.g., the radius) of the first outlet pipe 188*a* and the second outlet pipe 188*b* alters or influences the velocity V of the plunger 154.

Figure 9:
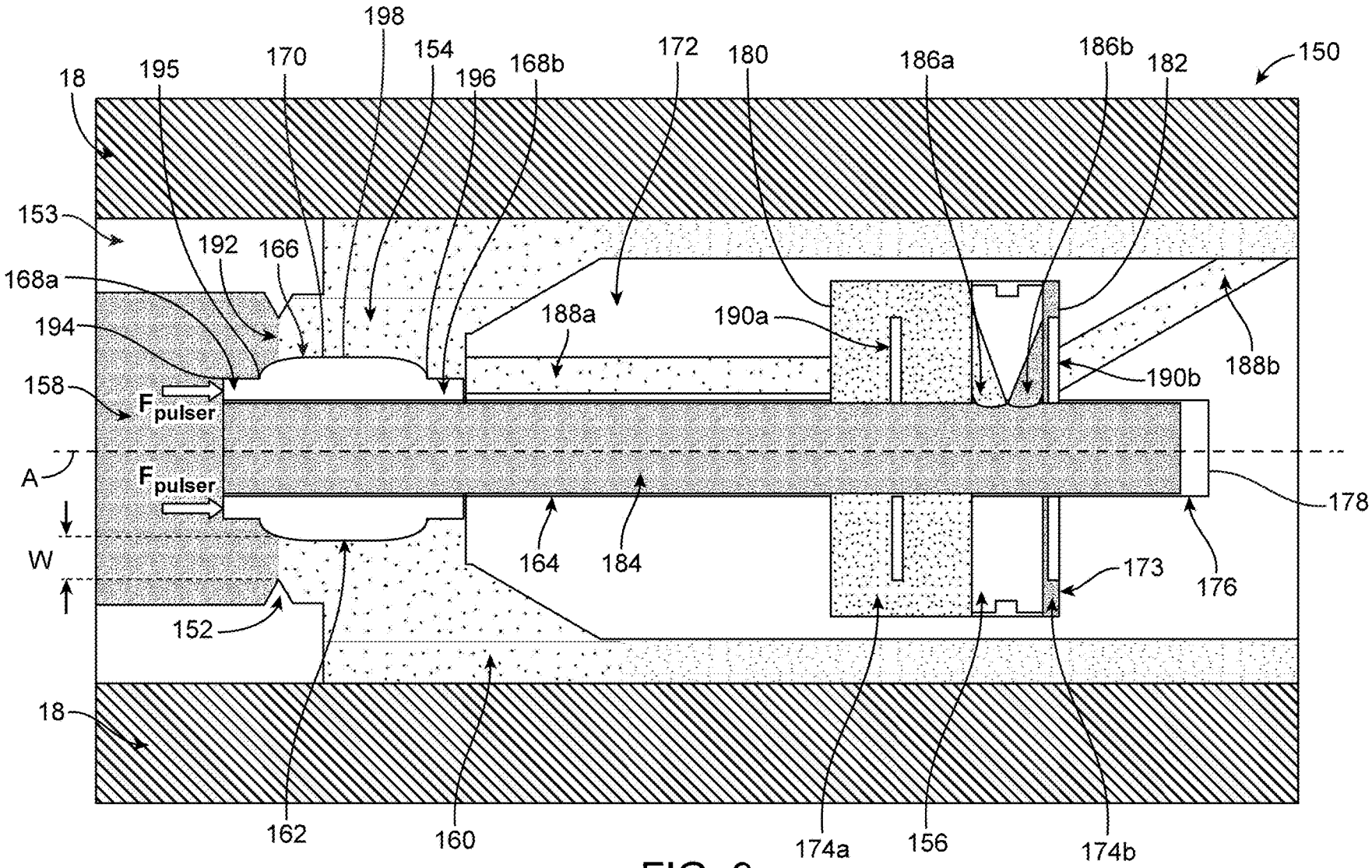
FIG. 9 illustrates a schematic view of the mud pulse telemetry system of FIG. 8 in a first stage of operation.

Turning to FIGS. 9-12, the pulser 154 may be supported for movement along the axis A between a downhole position and an uphole position during operation of the mud pulse telemetry system 150. Referring first to FIG. 9, the pulser 154 may occupy the downhole position when the first dwell region 168*a* is positioned proximate to the restriction 152 and the piston 156 is positioned proximate to the downhole end 182 of the cavity 173. In this position, the gap width W of the gap 192 may be imparted with a first gap width value, and the pressure differential $p_o$ across the restriction 152 may be imparted with a first pressure differential value.

The first outlet pipe 188*a* may be opened and the second outlet pipe 188*b* may be closed such that the uphole piston force $F_{up}$ drives the piston 156 and the pulser 154 uphole. As the pulser 154 leaves the downhole position and travels uphole, the center point 198 of the active region 166 approaches the restriction 152 and the pulser radius $r_{pulser}$ of the portion of the pulser body 162 positioned within the restriction 152 increases, thereby causing the gap width W to decrease. As a result, flow through the gap 192 becomes more restricted and the pressure differential $p_o$ across the restriction 152 increases. As the pressure differential $p_o$ increases, the second outlet pipe 188*b* may remain closed such that the flow of mud into the second piston chamber 174*b* increases, thereby causing the uphole piston force $F_{up}$ to increase and the uphole motion of the piston 156 to accelerate.

Turning to FIG. 10, the pulser 154 may pass through a middle position (e.g., where the center point 198 is positioned within the restriction 152) as the pulser 154 travels uphole. When the pulser 154 reaches the middle position, the gap width W may be imparted with a second gap width value less than the first gap width value, and the pressure differential $p_o$ across the restriction 152 may be imparted with a second pressure differential value less than the first pressure differential value.

As the pulser 154 leaves the middle position and continues to move uphole, the center point 198 moves away from the restriction 152 and the second dwell region 168*b* approaches the restriction 152. As the second dwell region 168*b* approaches the restriction 152, the pulser radius $r_{pulser}$ of the portion of the pulser body 162 positioned within the restriction 152 decreases, thereby causing the gap width W to increase. As a result, flow through the gap 192 becomes less restricted and the pressure differential $p_o$ across the restriction 152 decreases. As the pressure differential $p_o$ decreases, the flow of mud into the second piston chamber 174*b* via the second communication pipe 186*b* decreases, thereby causing the magnitude of the uphole piston force $F_{up}$ to decrease and the uphole motion of the pulser 154 to decelerate.

Figure 11:
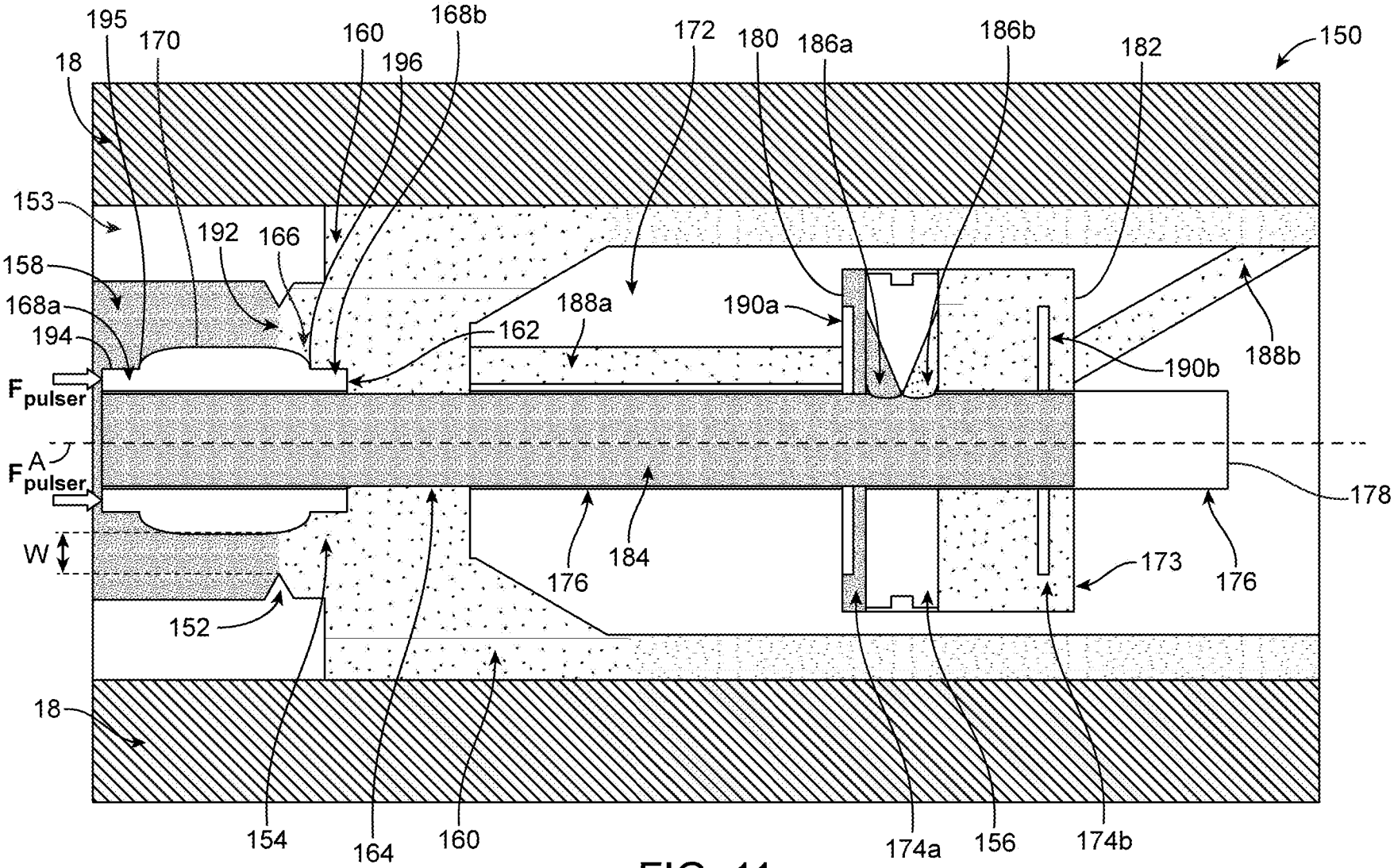
FIG. 11 illustrates a schematic view of the mud pulse telemetry system of FIG. 8 in a third stage of operation.

The pulser 154 may move uphole until the pulser 154 reaches the uphole position, shown in FIG. 11, where the piston 156 is positioned proximate to the uphole end 180 of the cavity 173. When the pulser 154 is in the uphole position, the gap width W may be imparted with a third gap width value greater than the second gap width value, and the pressure differential $p_o$ may be imparted with a third pressure differential value greater than the second pressure differential value. In some cases, the first gap width value may be substantially equal to the third gap width value, and the first pressure differential value may be substantially equal to the third pressure differential value.

When the pulser 154 reaches the uphole position, the first outlet pipe 188*a* may be closed and the second outlet pipe 188*b* may be opened. As a result, at least a portion of the pressure within the second piston chamber 174*b* may be released and pressurized mud may begin to flow into the first piston chamber 174*a* via the first communication pipe 186*a*. Thus, the downhole piston force $F_{down}$ may overcome the uphole piston force $F_{up}$ such that the piston 156 moves back toward the downhole end 182 of the cavity 173 and the pulser 154 begins to return to the downhole position.

Figure 12:
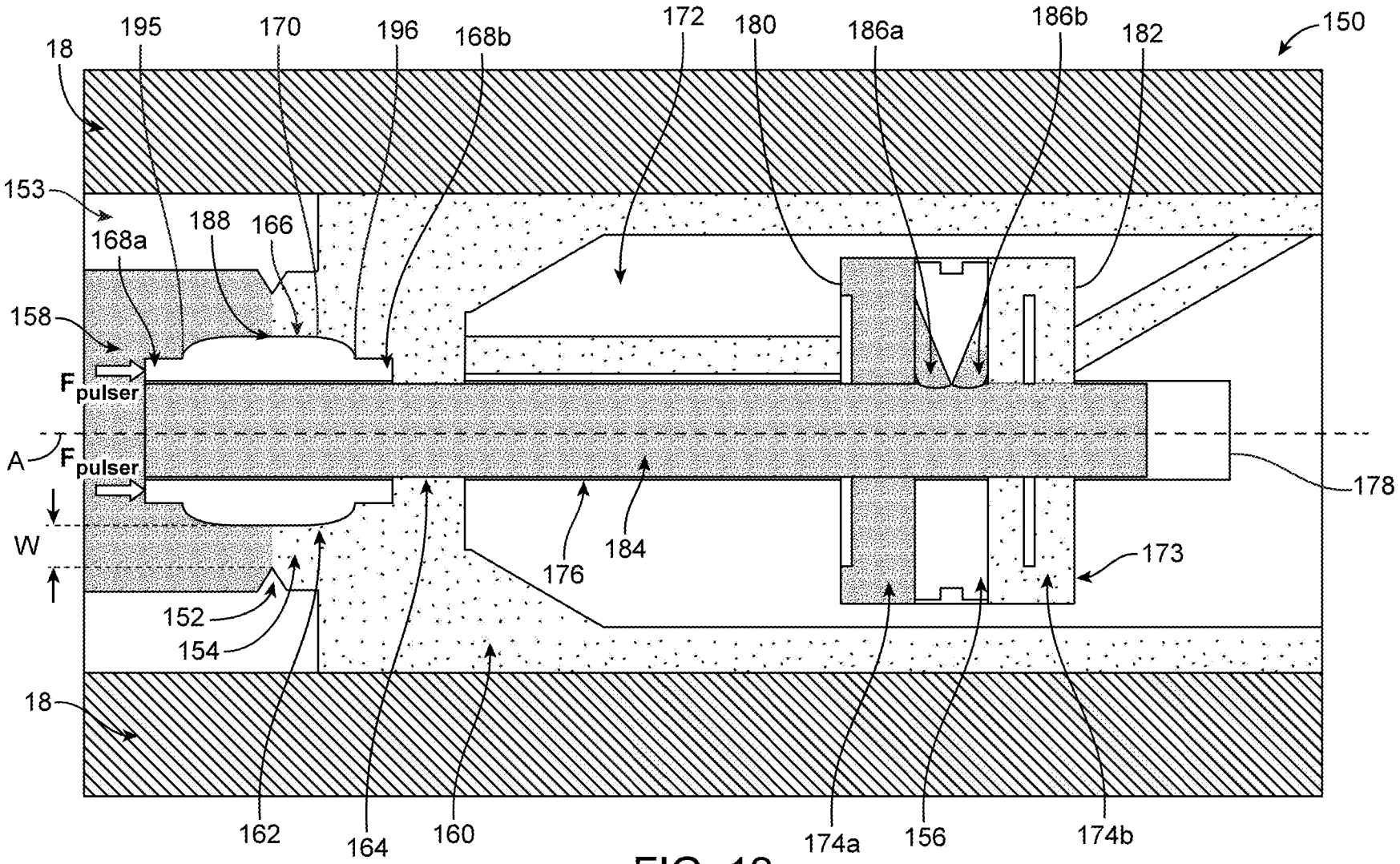
FIG. 12 illustrates a schematic view of the mud pulse telemetry system of FIG. 8 in a fourth stage of operation.

Turning to FIG. 12, the pulser 154 may return to the middle position as the pulser 154 returns downhole. As the pulser 154 leaves the uphole position and travels downhole, the center point 198 of the active region 166 approaches the restriction 152 and the pulser radius $r_{pulser}$ of the portion of the pulser body 162 positioned within the restriction 152 increases, thereby causing the gap width W to decrease. As a result, flow through the gap 192 becomes more restricted and the pressure differential $p_o$ across the restriction 152 increases. As the pressure differential $p_o$ increases, the first outlet pipe 188*a* may remain closed such that the flow of mud into the first piston chamber 174*a* increases, thereby causing the downhole piston force $F_{down}$ to increase and the downhole motion of the piston 156 to accelerate.

As the pulser 154 completes the return to the downhole position, the first dwell region 168*a* may approach the restriction 152 such that the pulser radius $r_{pulser}$ of the portion of the pulser body 162 positioned within the restriction 152 decreases, thereby causing the gap width W to increase. As a result, flow through the gap 192 becomes less restricted and the pressure differential $p_o$ across the restriction 152 decreases. As the pressure differential $p_o$ decreases, the first outlet pipe 188*a* may remain closed and the flow of mud into the first piston chamber 174*a* may decrease, thereby causing the downhole piston force $F_{down}$ to decrease and the downhole motion of the piston 156 to decelerate.

Once the pulser 154 returns to the downhole position, the first outlet pipe 188*a* may be opened and the second outlet pipe 188*b* may be closed such that at least a portion of the pressure within the first piston chamber 174*a* is released and pressurized mud once again flows into the second piston chamber 174*b*. In this way, the uphole piston force $F_{up}$ may once again overcome the downhole piston force $F_{down}$, and the cyclical axial motion of the pulser 154 may restart.

The magnitude of the change in pressure within the column of mud inside the drill string 18 may correspond to the velocity of the pulser 154. For example, if the pulser 154 moves uphole at a constant velocity V, the pressure within the drill string 18 will increase at a constant rate. However, if the pulser 154 moves uphole at an increasing velocity V (e.g., accelerates), the pressure within the drill string 18 will increase at an increasing rate. If the pulser 154 moves uphole at a decreasing velocity V (e.g., decelerates), the pressure within the drill string 18 will increase at a decreasing rate. Likewise, if the pulser 154 moves downhole at a constant velocity V, the pressure within the drill string 18 will decrease at a constant rate. However, if the pulser 154 moves downhole at an increasing velocity V (e.g., accelerates), the pressure within the drill string 18 will decrease at an increasing rate. If the pulser 154 moves downhole at a decreasing velocity V (e.g., decelerates), the pressure within the drill string will decrease at a decreasing rate.

In this way, by controlling the opening and closing of the first and second outlet pipes 188*a*, 188*b*, the cyclical motion of the pulser 154 within the drill string 18 may be modulated such that the resulting pressure wave detected uphole is sinusoidal (e.g., as opposed to a square, trapezoidal, or other irregularly shaped pressure wave). Thus, like the mud pulse telemetry system 50, the mud pulse telemetry system 150 may be configured to produce a carrier wave in the form of a sinusoidal pressure wave 102 or a pseudo-sinusoidal pressure wave 104 (FIG. 7).

With reference to the sinusoidal pressure wave 102 shown in FIG. 7, each point along the sinusoidal pressure wave 102 may correspond to an associated position of the pulser 154 with respect to the restriction 152. For example, the first point P1 corresponding to a minimum detected pressure within the high pressure region 158 may correspond to the downhole position of the pulser 154 (FIG. 9). The second outlet pipe 188*b* may be closed at or around the first point P1. The second point P2 may correspond to the middle position of the pulser 154 (FIG. 10) as the pulser 154 travels uphole. The third point P3 corresponding to a maximum detected pressure within the high pressure region 158 may correspond to the uphole position of the pulser 154 (FIG. 11). The first outlet pipe 188*a* may be closed and the second outlet pipe 188*b* may be opened at or around the third point P3. The fourth point P4 may correspond to the middle position of the pulser 154 (FIG. 12) as the pulser 154 travels downhole. The fifth point P5 may be associated with the return of the pulser 154 to the downhole position. The first outlet pipe 188*a* may be opened and the second outlet pipe 188*b* may be closed at or around the fifth point P5, and the cyclical axial motion of the pulser 154 may be restarted.

In some cases, the pressure within the high pressure region 158 may remain substantially constant for a brief period while the pulser 154 occupies the downhole position and/or the uphole position. For example, the pulser 154 may be configured to remain stationary for a brief period, or one of the dwell regions 168*a*, 168*b* may be positioned within the restriction 152 such that the pressure within the high pressure region 158 remains substantially constant. In these cases, the pressure detected at the surface, when graphed, may produce the pseudo-sinusoidal pressure wave 104 rather than the sinusoidal pressure wave 102. However, the principles of operation of the mud pulse telemetry system 150 remain the same regardless of whether the resulting pressure wave is sinusoidal or pseudo-sinusoidal.

Figure 13:
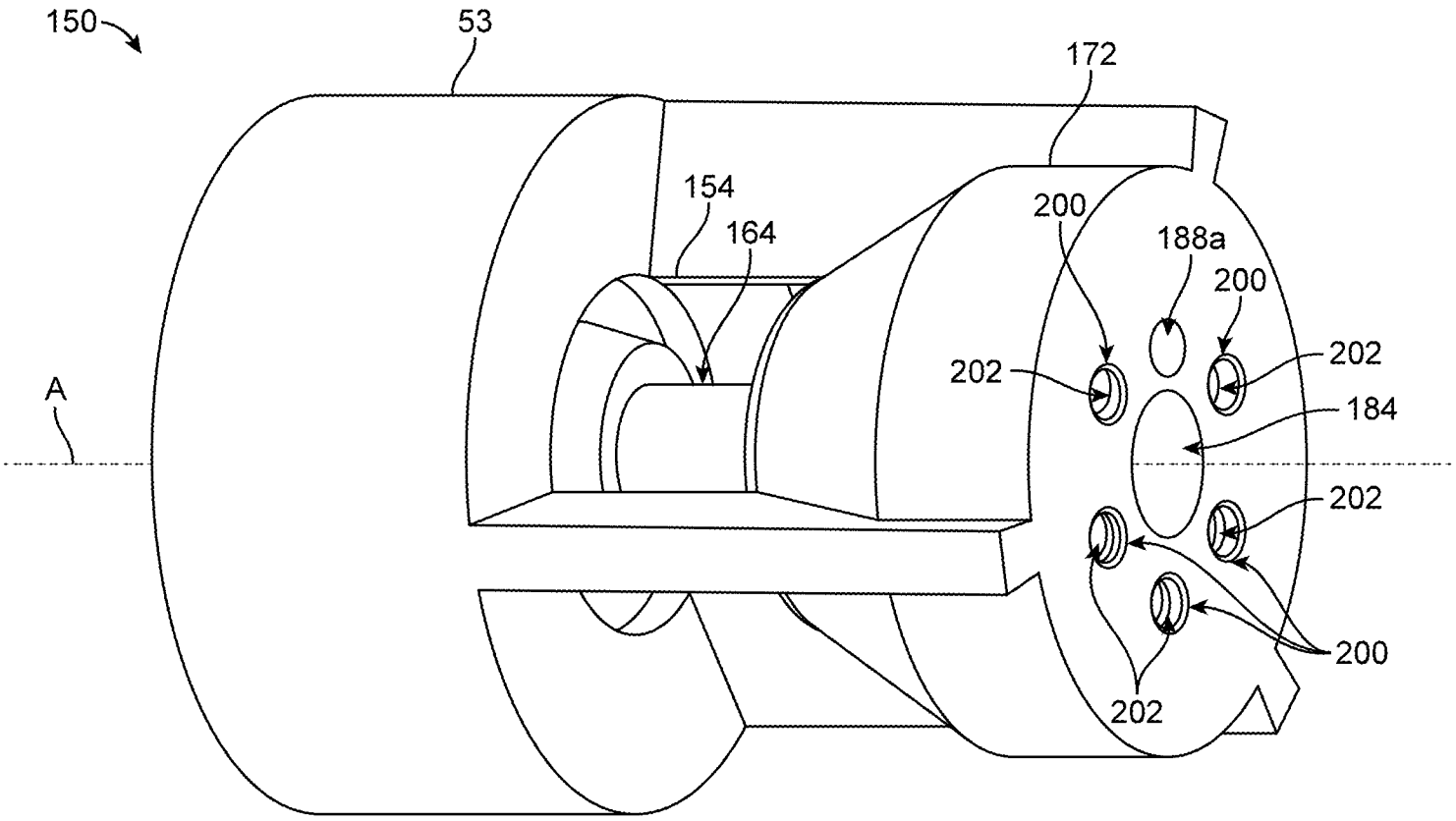
FIG. 13 illustrates a side isometric, cross-sectional view of a mud pulse telemetry system according to another embodiment.

As shown in FIG. 13, in some instances, the mud pulse telemetry system 150 may include one or more spring channels 200 retaining one or more springs 202. The springs 202 may be configured to control or influence the opening and closing of the first and second outlet pipes 188*a*, 188*b* in order to achieve a desired pattern of motion of the piston 156 and the pulser 154. For example, if the first and second outlet pipes 188*a*, 188*b* are opened purely due to motion, the hydraulic system may reach a point of equilibrium and the motion of the pulser 154 may stop (unless there is sufficient mass and/or velocity to prevent the pulser 154 from stopping). Thus, the springs 202 may provide a delay in the opening and closing of the first and second outlet pipes 188*a*, 188*b* such that cyclical axial motion of the pulser 154 may be maintained. In other words, the springs 202 may be configured to provide an artificial inertia to the motion of the pulser 154 and the piston 156 such that the pulser 154 can travel or accelerate beyond the pattern of motion that would be dictated by the fluid dynamics of the system alone.

Figure 14:
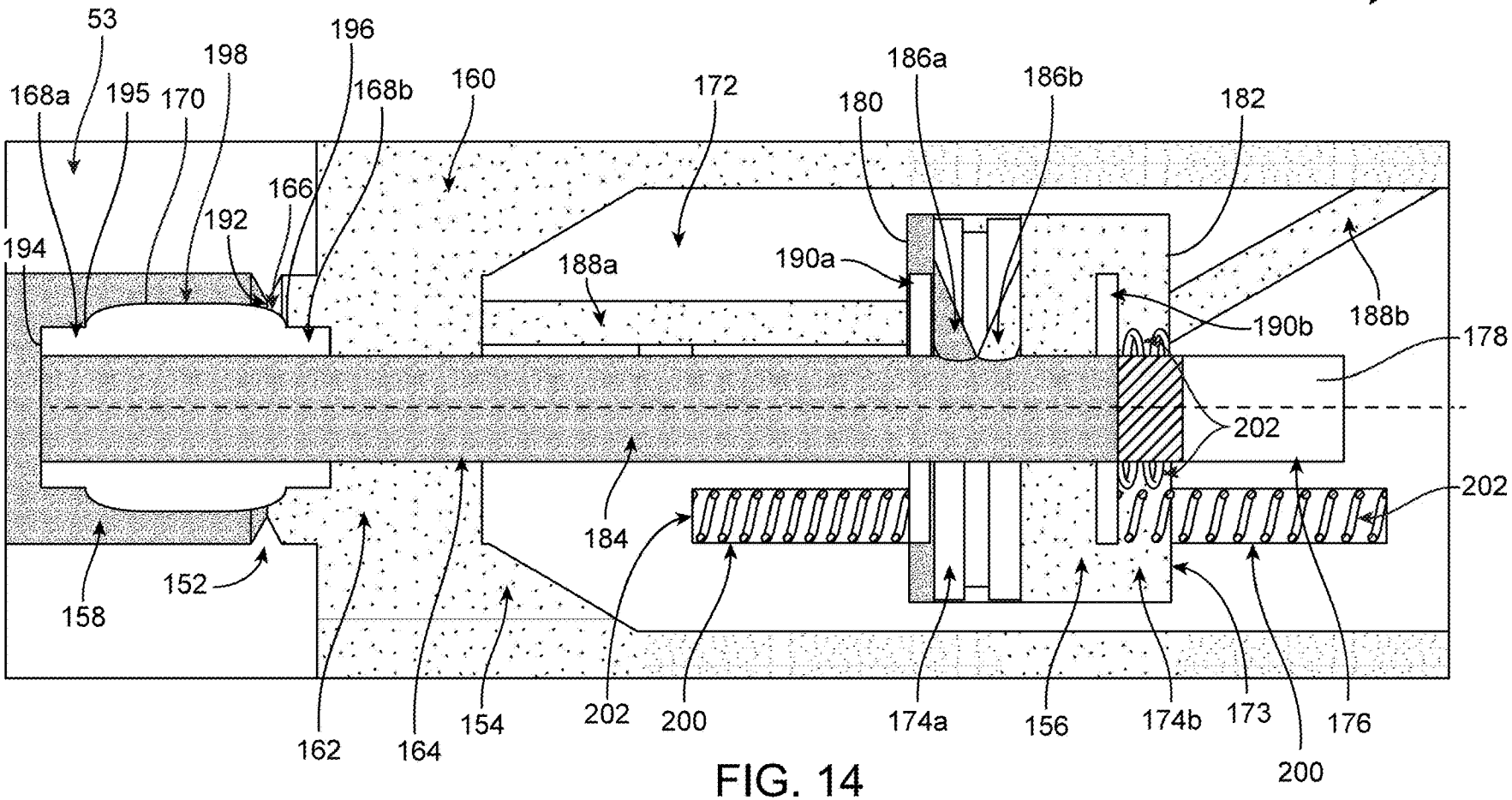
FIG. 14 illustrates a schematic view of the mud pulse telemetry system of FIG. 13.

In the example of FIGS. 13 and 14, five spring channels 200 (each configured to retain one spring 202) are disposed radially about the conduit 184 and extend at least partially through the piston barrel 172 along the axis A. However, any number of spring channels 200 and springs 202 may be provided. As best shown in FIG. 14, the piston barrel 172 may include spring channels 200 positioned uphole with respect to the cavity 173 and downhole with respect to the cavity 173. For example, the spring channels 200 uphole of the cavity 173 may house springs 202 configured to act on the first plate valve 190*a*. The spring channels 200 downhole of the cavity 173 may house springs 202 configured to act on the second plate valve 190*b*. The springs 202 acting on the first plate valve 190*a* may, for example, apply a downhole force that may aid in opening the first outlet pipe 188*a*. Similarly, the springs 202 acting on the second plate valve 190*b* may, for example, apply an uphole force that may aid in opening the second outlet pipe 188*b*.

When using the mud pulse telemetry system 50, mud pulse telemetry system 150, or other mud pulse telemetry systems in accordance with the principles of the present disclosure, the production of a sinusoidal carrier wave enables the transmission of information uphole using digital phase modulation. By manipulating or altering the wave transmitted uphole, information can be encoded via the differences between the expected waveform (e.g., the carrier wave) and the actual waveform detected at the surface.

Figure 15:
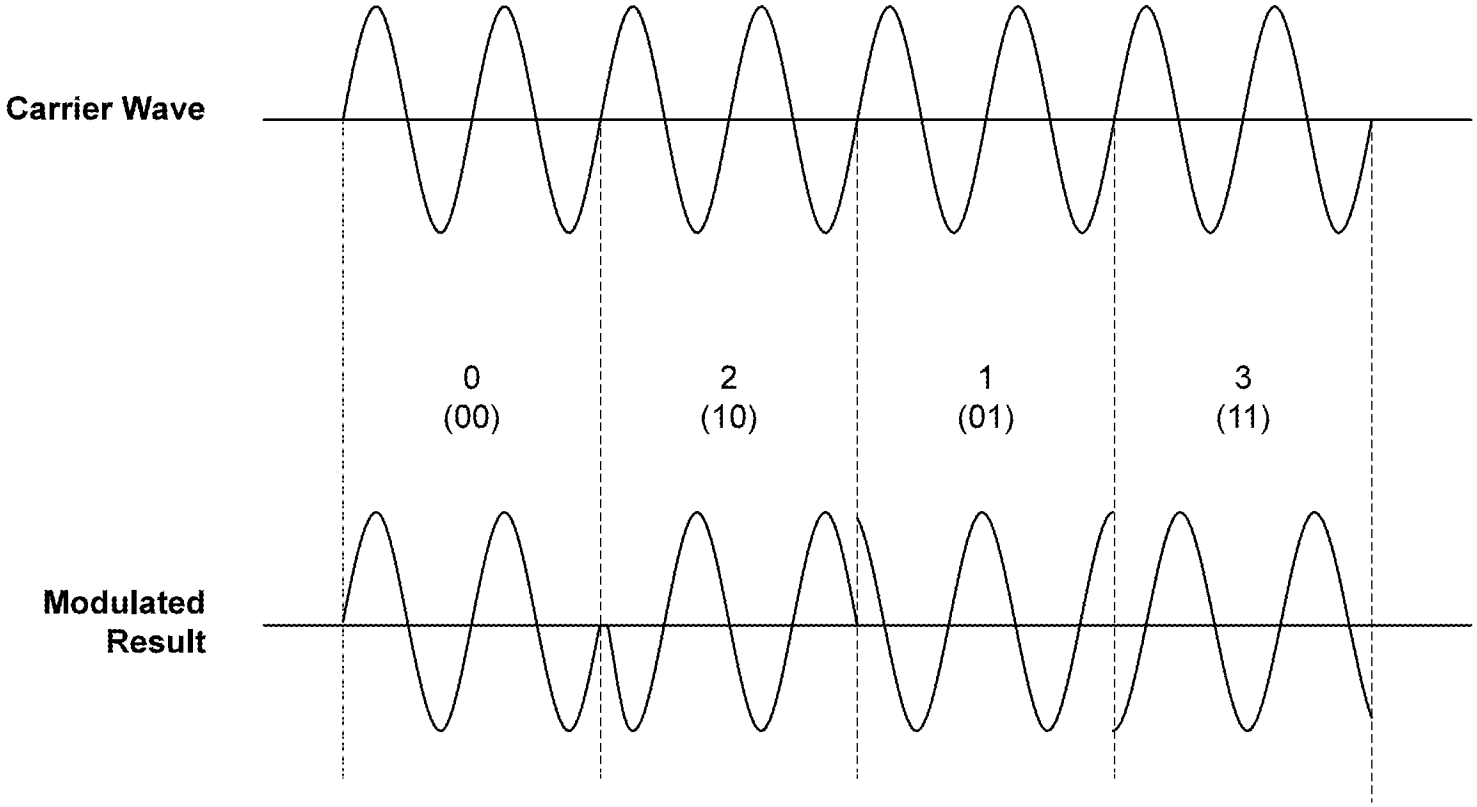
FIG. 15 illustrates a graphical representation of a technique for encoding information using the mud pulse telemetry system of FIG. 2, the mud pulse telemetry system of FIG. 8, the mud pulse telemetry system of FIG. 13, and/or the mud pulse telemetry system of FIG. 16.

For example, information may be encoded by selectively shifting the phase of the sinusoidal pressure wave produced by the cyclical axial motion of the pulser 54, 154. It will be understood that various phase modulation techniques may be used, including binary phase shift keying (BPSK), quadrature phase shift keying (QPSK), differential encoding, and the like. For example, as shown in FIG. 15, QPSK uses four phases (e.g., 45°, 135°, 225°, and) 315° to represent two bits of information at a time. Thus, a sensor at the surface may be configured to detect the pressure wave transmitted uphole by the pulser 54, 154 and a computer or processor may decode the bits of information encoded via shifts in the phase of the waveform. Shifting the phase of the pressure wave detected uphole may be achieved by manipulating, delaying, or otherwise altering the cyclical axial motion of the pulser 54, 154.

With respect to the mud pulse telemetry system 50 (FIG. 2), operation of the piston valve 88 may be delayed in order to shift the phase of the pressure wave detected uphole. For example, the piston valve 88 is typically opened when the pulser 54 reaches the uphole position (FIG. 6) so that pressure within the piston chamber 74 is released and the pulser 54 begins to travel back to the downhole position. However, by delaying the opening of the piston valve 88 by a desired period of time, the return motion of the pulser 54 can be delayed and the phase of the waveform detected uphole can be shifted.

In some cases, the first and second dwell regions 68*a*, 68*b* may be configured to aid in shifting the phase of the pressure wave. For example, the first dwell region 68*a* or the second dwell region 68*b* may be positioned within the restriction 52 while the motion of the pulser 54 is delayed. The first and second dwell regions 68*a*, 68*b* may be imparted with a substantially cylindrical structure such that minor oscillations of the pulser 54 can cause the pulser 54 to move along the axis A without changing the gap width W. Thus, the pressure within the high pressure region 58 can remain constant even if the pulser 54 will not remain absolutely still with respect to its position along the axis A.

Shifting the phase of the pressure wave produced by the mud pulse telemetry system 150 may be achieved in a substantially similar manner. Operation of the first and second plate valves 190*a*, 190*b* or other mechanism configured to open and close the first and second outlet pipes 188*a*, 188*b* may be delayed in order to shift the phase of the pressure wave detected uphole (FIG. 8). For example, the first outlet pipe 188*a* is typically closed when the pulser 154 reaches the uphole position (FIG. 11) such that mud flowing into the first piston chamber 174*a* via the first communication pipe 186*a* increases the pressure within the first piston chamber 174*a* and pushes the piston 156 downhole (e.g., toward the downhole end 182 of the cavity 173). However, by delaying the opening of the first outlet pipe 188*a* by a desired period of time, the return motion of the pulser 154 can be delayed and the phase of the waveform detected uphole can be shifted.

The first and second dwell regions 168*a*, 168*b* of the pulser 154 may be configured to aid in shifting the waveform produced by the mud pulse telemetry system 150 in a manner similar to that of the first and second dwell regions 68*a*, 68*b* of the pulser 54. For example, the first dwell region 168*a* or the second dwell region 168*b* may be positioned within the restriction 152 while the cyclical motion of the pulser 154 is delayed. In this way, the first and second dwell regions 168*a*, 168*b* may allow for minor oscillations of the pulser 154 along the axis A without changing the gap width W and without altering the pressure within the high pressure region 158.

Figure 16:
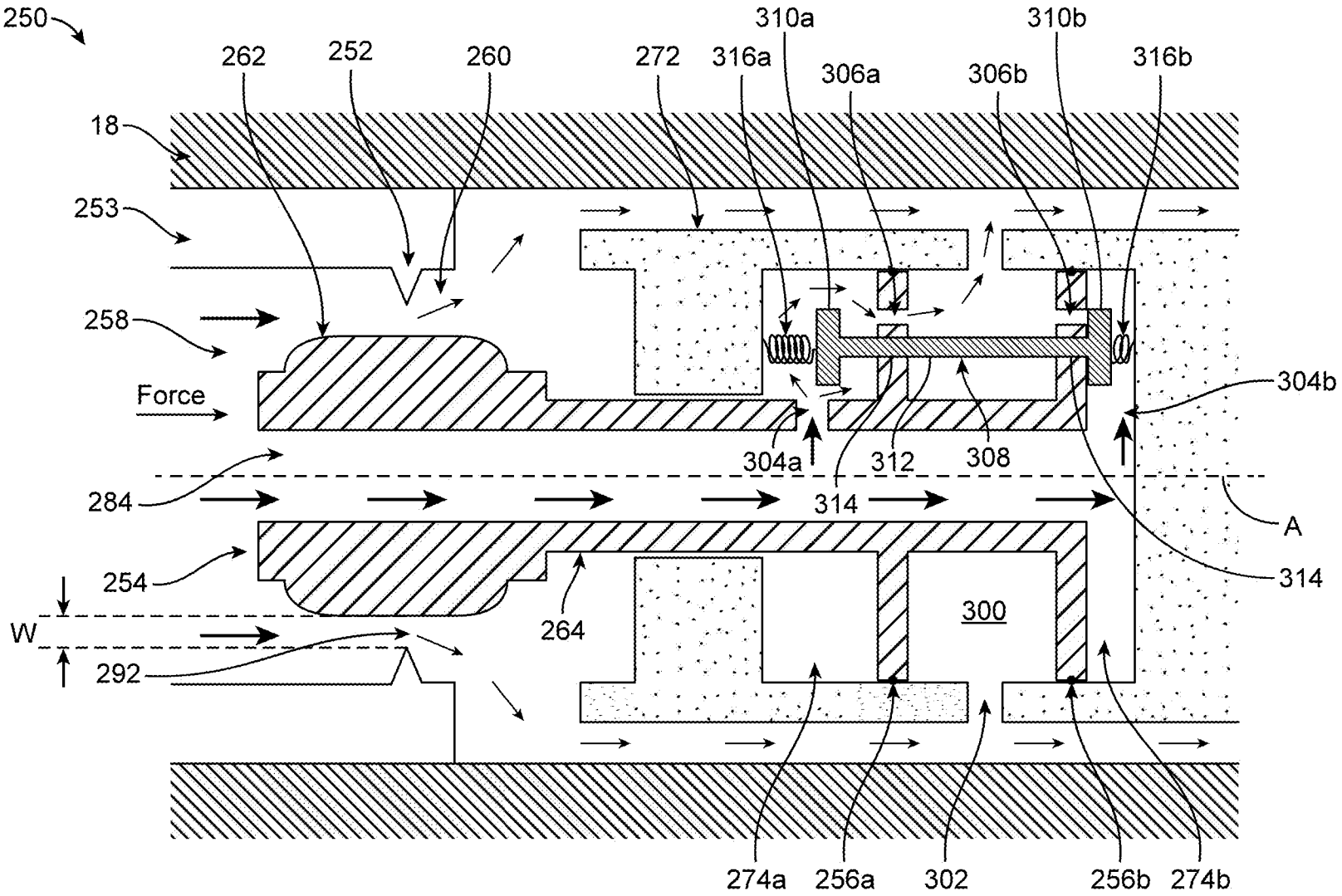
FIG. 16 illustrates a schematic view of a mud pulse telemetry system according to a further embodiment.

Another mud pulse telemetry system 250 is depicted in FIG. 16. The mud pulse telemetry system 250 functions in a manner similar to that of the mud pulse telemetry systems 50, 150. Components of the mud pulse telemetry system 250 and components of the mud pulse telemetry system 150 that have similar names and/or reference numbers with a difference of exactly 100 may be substantially similar in form and function.

The mud pulse telemetry system 250 may include a collar 253 positioned within the drill string 18 and a restriction 252 connected to the collar 253 and extending inwardly therefrom such that a pressure differential is created between a high pressure region 258 uphole with respect to the restriction and a low pressure region 260 downhole with respect to the restriction. A pulser 254 including a pulser body 262 and a pulser stem 264 connected to the pulser body 262 and extending outwardly therefrom may be positioned at least partially within the collar 253 and configured for axial motion within the drill string 18 such that the pulser body 262 moves axially within the restriction 252. Thus, a gap 292 defined by a width W may be positioned between the restriction 252 and the exterior surface of the portion of the pulser body 262 positioned within the restriction 252 at a given point in time. As the pulser body 262 moves within the restriction 252, the width W of the gap 292 fluctuates, thereby altering the flow through the gap 292 and causing the pressure differential between the high pressure region 258 and the low pressure region 260 to fluctuate.

The mud pulse telemetry system 250 may differ from the mud pulse telemetry systems 50, 150 when it comes to the mechanism driving the axial motion of the pulser 254. For example, a piston barrel 272 positioned downhole with respect to the pulser body 262 may retain a first piston 256*a* and a second piston 256*b*. The first and second pistons 256*a*, 256*b* may each be formed integrally with or coupled to the pulser stem 264 and configured to move therewith. The piston barrel 272 may define a first piston chamber 274*a* positioned uphole with respect to the first piston 256*a*, a second piston chamber 274*b* positioned downhole with respect to the second piston 256*b*, and an intermediate region 300 positioned between the first piston 256*a* and the second piston 256*b*. The intermediate region 300 may be in fluid communication with the low pressure region 260 via an intermediate region outlet 302 extending entirely through the piston barrel 272. Thus, the pressure within the intermediate region 300 is maintained at a level that is substantially the same as or that corresponds to the pressure within the low pressure region 260.

The first piston 256*a* may be defined by a first diameter and the second piston 256*b* may be defined by a second diameter. In some embodiments, the first diameter and the second diameter may be substantially equal, and in other embodiments, the first diameter and the second diameter may be different. The first piston chamber 274*a* and second piston chamber 274*b* may each be fed by (e.g., may be in fluid communication with) a central conduit 284 extending entirely through the pulser 254 along a central longitudinal axis A of the pulser 254. Thus, the first and second piston chambers 274*a*, 274*b* may each be pressurized by fluid (e.g., mud) from the high pressure region 258 flowing through the central conduit 284 and into the first piston chamber 274*a* or the second piston chamber 274*b* via inlets 304 formed in the pulser stem 264. For example, a first inlet 304*a* configured to provide fluid communication between the central conduit 284 and the first piston chamber 274*a* may be positioned in a first location along the pulser stem 264. A second inlet 304*b* configured to provide fluid communication between the central conduit 284 and the second piston chamber 274*b* may be provided in a second location along the pulser stem 264 (e.g., the second location may be downhole with respect to the first location).

The first piston 256*a* and the second piston 256*b* may each include a choke 306 provided in the form of an opening to the intermediate region 300. For example, a first choke 306*a* may be formed in the first piston 256*a* and may facilitate fluid communication between the first piston chamber 274*a* and the intermediate region 300. A second choke 306*b* may be formed in the second piston 256*b* and may facilitate fluid communication between the second piston chamber 274*b* and the intermediate region 300. The chokes 306 may be imparted with a diameter greater than that of the associated inlet 304 (e.g., the first choke 306*a* may have a greater diameter than the first inlet 304*a* and the second choke 306*b* may have a greater diameter than the second inlet 304*b*). In some embodiments, the first and second chokes 306*a*, 306*b* are substantially the same size and the first and second inlets 304*a*, 304*b* are substantially the same size. In other embodiments, the first and second chokes 306*a*, 306*b* and the first and second inlets 304*a*, 304*b* may be different sizes.

A shuttle valve 308 may engage or may be operably connected to the first piston 256*a* and the second piston 256*b*. For example, the shuttle valve 308 may be configured to selectively open and close the first choke 306*a* and the second choke 306*b*. The shuttle valve 308 may include a first disc 310*a* positioned within the first piston chamber 274*a*, a second disc 310*b* positioned within the second piston chamber 274*b*, and a valve stem 312 extending between the first disc 310*a* and the second disc 310*b*. The valve stem 312 may extend entirely through the intermediate region 300 and may be slidably received by or positioned within stem openings 314 formed in the first piston 256*a* and the second piston 256*b* such that the shuttle valve 308 is capable of motion along the axis A relative to the first and second pistons 256*a*, 256*b*.

Operation of the shuttle valve 308 may be aided by one or more valve springs 316. For example, a first valve spring 316*a* positioned within the first piston chamber 274*a* may be configured to apply a downhole biasing force to the shuttle valve 308 (e.g., via engagement with the first disc 310*a*), and a second valve spring 316*b* positioned within the second piston chamber 274*b* may be configured to apply an uphole biasing force to the shuttle valve 308 (e.g., via engagement with the second disc 310*b*). In some embodiments, the shuttle valve 308 and the valve springs 316 may be configured such that, when the mud pulse telemetry system 250 is in use, the first choke 306*a* is closed when the second choke 306*b* is open and the second choke 306*b* is closed when the first choke 306*a* is open. Thus, the first and second pistons 256*a*, 256*b* and the shuttle valve 308 may drive cyclical axial motion of the pulser 256 in a manner similar to that described above with respect to the mud pulse telemetry systems 50, 150.

In the configuration depicted in FIG. 16, the first choke 306*a* is open and the second choke 306*b* is blocked by the second disc 310*b*. In this position, pressurized fluid from the high pressure region 258 flows through the central conduit 284 and into the first piston chamber 274*a* via the first inlet 304*a* and into the second piston chamber 274*b* via the second inlet 304*b*. The pressurized fluid flows through the first piston chamber 274*a* and into the intermediate region via the first choke 306*a* since the first choke 306*a* is not blocked by the shuttle valve 308. However, the pressurized fluid causes pressure to accumulate in the second piston chamber 274*b* since the second choke 306*b* is blocked. Thus, the pressure in the second piston chamber 274*b* acts on the second piston 256*b* and the pressure differential (e.g., the differential in pressure between the second piston chamber 274*b* when the second choke 306*b* is blocked and the pressure in the intermediate region 300) causes the pulser 254 to move uphole. Additionally, the pressure differential presses the second disc 310*b* against the second piston 256*b* such that the second choke 306*b* remains closed. The uphole biasing force applied by the second valve spring 316*b* may supplement the pressure within the second piston chamber 274*b* in terms of pushing the pulser 254 uphole and/or retaining the second disc 310*b* against the second piston 256*b* such that the second choke 306*b* remains blocked.

As the pulser 254 and the shuttle valve 308 move uphole, the first valve spring 316*a* may be compressed while the second valve spring 316*b* is permitted to expand or relax, thereby causing the downhole biasing force applied by the first valve spring 316*a* to increase and the uphole biasing force applied by the second valve spring 316*b* to decrease. Eventually, the downhole biasing force applied by the first valve spring 316*a* and/or the pressure within the first piston chamber 274*a* may overcome the force maintaining the second choke 306*b* in a blocked state (e.g., by pushing the shuttle valve 308 downhole relative to the first and second pistons 256*a*, 256*b*). When the second choke 306*b* opens, pressurized fluid within the second piston chamber 274*b* is permitted to flow through the intermediate region 300 and into the low pressure region 260 such that pressure within the second piston chamber 274*b* decreases. The change in pressure within the second piston chamber 274*b* may be sudden and may force the shuttle valve 308 downhole such that the first disc 310*a* blocks the first choke 306*a* (e.g., via the first disc 310*a*).

With the first choke 306*a* blocked by the shuttle valve 308, the process may be reversed. For example, pressurized fluid may flow through the central conduit 284 and into the first piston chamber 274*a* via the first inlet 304*a*, thereby causing pressure to build up within the first piston chamber 274*a*. The pressure build up within the first piston chamber 274*a* (and, in some cases, the downhole biasing force applied by the first valve spring 316*a*) may cause the pulser 254 to return downhole. In this way, the shuttle valve 308 may be configured to generate or facilitate cyclical axial motion of the pulser 254 such that the pulser body 262 moves cyclically within the restriction 252 and transmits a sinusoidal or pseudo-sinusoidal pressure wave (FIG. 7) uphole via the mud within the drill string 18.

In other embodiments, other configurations are possible. For example, those of skill in the art will recognize, according to the principles and concepts disclosed herein, that various combinations, sub-combinations, and substitutions of the components discussed above can provide a mud pulse telemetry system.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A mud pulse telemetry system, comprising:

a drill string configured to be positioned in a wellbore;

a restriction positioned within the drill string and configured to create a pressure differential between a high pressure region of the drill string on a first side of the restriction and a low pressure region of the drill string on a second side of the restriction;

a piston including a piston opening, the piston positioned in a piston chamber and movable along an axis between a first position and a second position;

a valve movable to selectively open the piston opening; and a pulser coupled to the piston and positioned for movement within the drill string along the axis, the pulser including, a pulser body at least partially disposed within the restriction and including an outer surface, at least a portion of the outer surface having a non-linear profile, wherein movement of the pulser body generates a pressure wave through mud within the drill string; and a conduit extending through the pulser body, the conduit facilitating fluid communication between the drill string and the piston chamber.

2. The system of claim 1, wherein the outer surface of the pulser body is spaced apart from an inner edge of the restriction by a gap, a width of the gap changing as the pulser body moves past the restriction.

3. The system of claim 2, wherein the restriction is a knife edge restriction with an annular edge, and the gap is an annular gap.

4. The system of claim 2, wherein the restriction generates a pressure differential across the gap.

5. The system of claim 4, wherein the pressure differential varies based on the pulser body's position with respect to the restriction.

6. The system of claim 2, wherein the piston causes the pulser to move uphole when mud flows into the piston chamber via the conduit and the valve is in a closed position.

7. The system of claim 6, wherein the piston causes the pulser to move downhole when the valve moves to an open position and mud exits the piston chamber via the piston opening.

8. The system of claim 7, wherein movement of the valve between the closed position and the open position causes the pulser to reciprocate axially within the drill string.

9. The system of claim 1, wherein the portion of the outer surface having a non-linear profile is defined by a logarithmic curve.

10. The system of claim 1, further comprising:

a first dwell region connected to a first end of the pulser body and a second dwell region connected to a second end of the pulser body, wherein the dwell regions are configured to facilitate idling of the pulser such that a phase of the pressure wave transmitted uphole can be shifted.

11. The system of claim 1, wherein the pressure wave is sinusoidal.

12. The system of claim 11, wherein actuation of the valve is controllable to alter the movement of the pulser, thereby shifting a phase of the sinusoidal pressure wave.

13. The system of claim 1, further comprising:

a bearing supporting at least a portion of the pulser for axial motion within the drill string, wherein the valve is self-actuating in that the valve is arranged to engage a portion of the bearing when the pulser reaches an uphole position and the valve is arranged to engage a portion of the piston chamber when the pulser reaches a downhole position, and wherein engagement between the valve and the bearing causes the piston opening to open and engagement between the valve and the piston chamber causes the piston opening to close.

14. A mud pulse telemetry system, comprising:

a drill string;

a pulser positioned within the drill string; and a piston disposed within the drill string and connected to the pulser, the piston configured to generate axial movement of the pulser within the drill string, wherein a portion of the pulser is defined by a transcendental function, wherein the transcendental function is an exponential equation, a logarithmic equation, a trigonometric equation or any combination thereof, wherein axial movement of the pulser within the drill string generates a sinusoidal pressure wave to the surface via mud within the drill string.

15. The system of claim 14, wherein information is encoded in the sinusoidal pressure wave using phase modulation.

16. The system of claim 14, wherein a shape of the portion of the pulser defined by a transcendental function causes the pulser to accelerate or decelerate as the pulser moves axially within the drill string such that the pressure wave generated by the axial movement of the pulser is sinusoidal.

17. The system of claim 14, wherein the pulser is positioned within a restriction of the drill string such that a gap is formed between the restriction and the pulser.

18. The system of claim 17, wherein the restriction generates a pressure differential across the gap.

19. A mud pulse telemetry system, comprising:

a drill string;

a pulser supported for axial motion within the drill string between an uphole position and a downhole position;

a restriction positioned within the drill string and configured to generate a pressure differential therein between a high pressure region adjacent one side of the restriction and a low pressure region on another side of the restriction;

a conduit extending through the pulser, the conduit including a first communication passage facilitating fluid communication between a first piston chamber and the high pressure region and a second communication passage facilitating fluid communication between a second piston chamber and the high pressure region;

a first outlet pipe facilitating fluid communication between the first piston chamber and the low pressure region, a first valve configured to selectively open and close the first outlet pipe; and a second outlet pipe facilitating fluid communication between the second piston chamber and the low pressure region, a second valve configured to selectively open and close the second outlet pipe, cyclical axial motion of the pulser within the drill string generating a sinusoidal pressure wave in an uphole direction.

* * * * *